US009285697B2

(12) United States Patent
Fukudome et al.

(10) Patent No.: US 9,285,697 B2
(45) Date of Patent: Mar. 15, 2016

(54) TONER

(71) Applicant: CANON KABUSHIKI KAISHA, Tokyo (JP)

(72) Inventors: Kosuke Fukudome, Tokyo (JP); Shuhei Moribe, Mishima (JP); Naoki Okamoto, Mishima (JP); Kunihiko Nakamura, Gotemba (JP); Noriyoshi Umeda, Suntou-gun (JP); Yoshiaki Shiotari, Mishima (JP); Satoshi Mita, Fukuyama (JP); Tetsuya Ida, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 61 days.

(21) Appl. No.: 14/446,971

(22) Filed: Jul. 30, 2014

(65) Prior Publication Data

US 2015/0037727 A1 Feb. 5, 2015

(30) Foreign Application Priority Data

Aug. 1, 2013 (JP) ..... 2013-160759

(51) Int. Cl.
*G03G 9/00* (2006.01)
*G03G 9/087* (2006.01)

(52) U.S. Cl.
CPC ..... *G03G 9/08755* (2013.01); *G03G 9/08788* (2013.01); *G03G 9/08795* (2013.01); *G03G 9/08797* (2013.01)

(58) Field of Classification Search
CPC ..... G03G 9/08755; G03G 9/08788; G03G 9/08797; G03G 9/08795
USPC ..... 430/109.3, 109.1, 109.4
See application file for complete search history.

(56) References Cited

U.S. PATENT DOCUMENTS 6,780,557 B2 8/2004 Kawaji et al.
7,041,422 B2 5/2006 Shirai et al.
2005/0227160 A1* 10/2005 Shirai ..... G03G 9/083 430/109.4
2011/0171574 A1* 7/2011 Hara ..... G03G 9/09371 430/137.11

(Continued)

FOREIGN PATENT DOCUMENTS

JP 2003-173047 A 6/2003
JP 2003-337443 A 11/2003

(Continued)

OTHER PUBLICATIONS

U.S. Appl. No. 14/444,989, filed Jul. 28, 2014. Applicant: Shuhei Moribe, et al.

(Continued)

*Primary Examiner* — Thorl Chea
(74) *Attorney, Agent, or Firm* — Fitzpatrick, Cella, Harper and Scinto

(57) ABSTRACT

Provided is a toner has toner particle containing a crystalline polyester resin A, an amorphous resin B and a colorant, wherein (1) the crystalline polyester resin A is a resin that has a crystal nucleating agent segment (D) on the end of a polyester molecular chain (C), (2) the amorphous resin (B) is a hybrid resin in which a polyester unit (E) and a vinyl polymer unit (F) are chemically bonded, and (3) the SP value of the polyester molecular chain (C) (Sc), the SP value of the crystal nucleating agent segment (D) (Sd), the SP value of the polyester unit (E) (Se) and the SP value of the vinyl polymer unit (F) (Sf) satisfy specific relationships.

8 Claims, 1 Drawing Sheet

(56) References Cited

U.S. PATENT DOCUMENTS

2013/0171556 A1 7/2013 Fujikawa et al.
2013/0344430 A1* 12/2013 Terauchi ..... G03G 9/08755
430/109.31

FOREIGN PATENT DOCUMENTS

JP 2006-113473 A 4/2006
JP 2007-33773 A 2/2007
JP 2010-152102 A 7/2010

OTHER PUBLICATIONS

R. F. Fedors, "A Method for Estimating Both the Solubility Parameters and Molar Volumes of Liquids", Polymer Engineering and Science, Feb. 1974, vol. 14, No. 2.

* cited by examiner

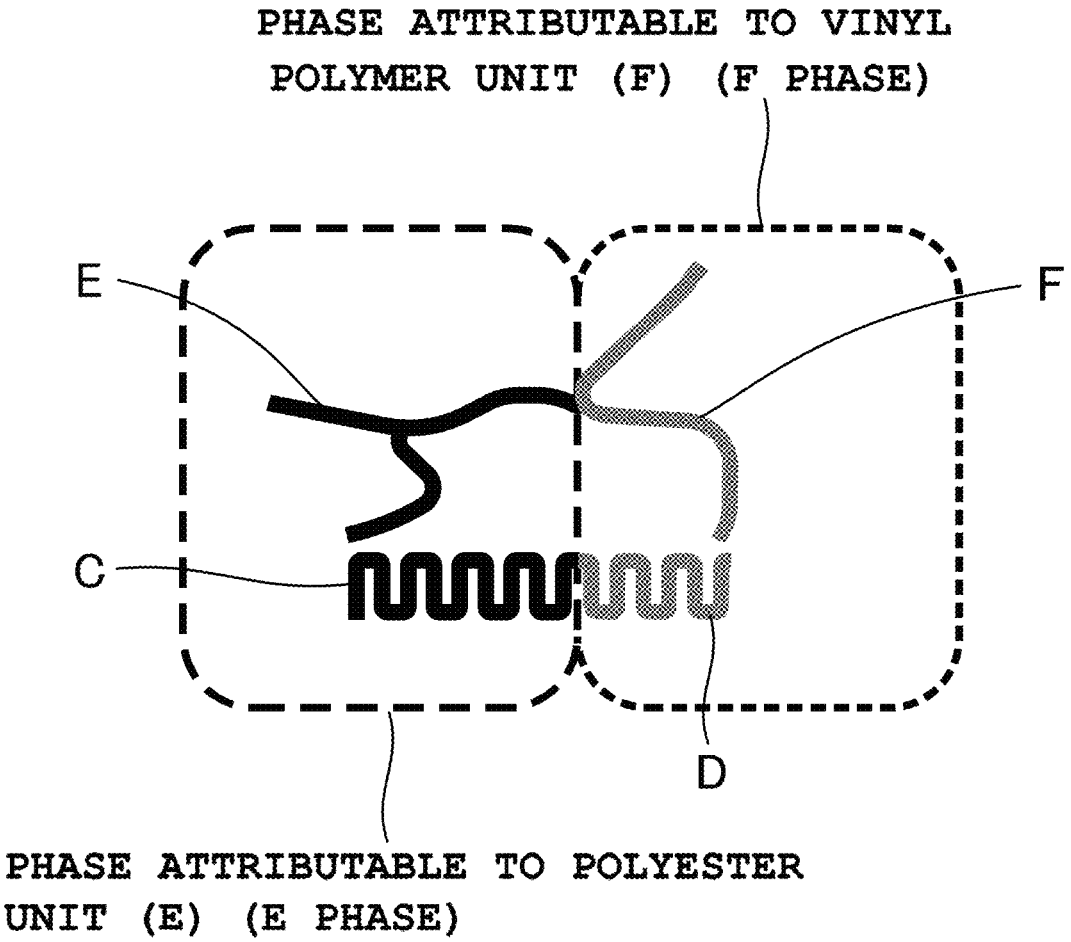
PHASE ATTRIBUTABLE TO VINYL POLYMER UNIT (F) (F PHASE)
E
F
C
D
PHASE ATTRIBUTABLE TO POLYESTER UNIT (E) (E PHASE)

TONER

BACKGROUND OF THE INVENTION

1. Field of the Invention

The present invention relates to a toner used in an electrophotographic method, an image-forming method for actualizing an electrostatic image, and a toner jet.

2. Description of the Related Art

Image-forming apparatuses using an electrophotographic method have recently been required to demonstrate faster speeds and higher reliability.

In addition, there also growing demands for improved appearance of the image as well as energy savings, shortening of wait time and improvement of image productivity, and toners are required to demonstrate superior low-temperature fixing performance in order to respond thereto.

In general, low-temperature fixing performance is related to the viscosity of the toner, and toners are required to have the property of being rapidly melted by heat during fixation (so-called sharp melt property).

Accompanying recent increases in printer speed in particular, the amount of time during which the toner and paper or other media pass through the nip of the fixing apparatus is becoming shorter each year. In addition, there are a growing number of opportunities for users to continuously output images of high quality having a high coverage rate onto heavy paper in the manner of graphic images or posters using an image-forming apparatus such as a laser printer.

In the case of using heavy paper, since the amount of heat lost to the paper during fixation increases, it becomes difficult to transfer heat from the fixing member on the paper side to the toner, thereby resulting in inadequate melting of the toner contacting the outermost layer of the paper and increased susceptibility to poor toner fixing performance. In addition, in the case of images having a high coverage rate, since a state results in which much of the toner is layered on the paper during fixation, it again becomes difficult to transfer heat from the fixing member on the toner side to the outermost layer of the paper, resulting in even an even greater likelihood of poor fixing performance.

Consequently, in the case of outputting images having a high coverage rate using heavy paper, there were many cases in which means were devised for changing the fixing conditions, such as by lowering the printing speed of the fixing apparatus to a speed lower than that of ordinary paper or by increasing the set temperature of the fixing apparatus in order to increase the amount of heat transferred to the toner.

However, image productivity is sacrificed in the case of means for lowering the printing speed of the fixing apparatus, while it becomes difficult to save energy or shorten wait time in the case of means for increasing the set temperature of the fixing apparatus.

As has been described above, although there is a need for a toner that can be fixed under the same fixing conditions as ordinary paper even when using heavy paper, a toner capable of satisfying that requirement has yet to be obtained.

Numerous toners have been proposed as examples of technology for improving toner low-temperature fixability that contain not only an amorphous resin but also a crystalline polyester resin for use as a binder resin (see, for example, Japanese Patent Application Laid-open No. 2003-337443).

Toners containing a crystalline polyester resin are able to improve low-temperature fixability as a result of the crystalline polyester resin melting and becoming compatible with amorphous resin due to the heat during fixation, and the binder resin being plasticized due to this compatibility, thereby resulting in an enhanced sharp melt property.

However, in order to print images having a high coverage rate using heavy paper at high speed, the speed at which the crystalline polyester resin plasticizes the binder resin during fixation (to also simply be referred to as the plasticizing speed during fixation) is inadequate, thereby resulting in the need for further improvement.

In addition, when low-temperature fixability is attempted to be improved, there are cases in which toner durability and the rate at which charging rises up become poor, and a toner that satisfies all of these requirements with respect to low-temperature fixability, durability and the rate at which charging rises up has yet to be obtained at the present time.

For example, if compatibility between a crystalline polyester resin and an amorphous resin is made to be excessively high in order to improve low-temperature fixability, the crystalline polyester resin ends up melting even at normal temperatures, resulting in a toner that contains plasticized, soft toner particles.

As a result, the toner has weak durability with respect to external stress such as that applied when stirring the developer, and in the case of outputting low coverage images such as half-tone images in a mode that is severe on toner deterioration in the manner of continuous output, there is increased susceptibility to a decrease in image density caused by increased attachment force of the toner surface caused by embedding external additives. In this manner, it was difficult to realize both toner low-temperature fixability and durability in toners containing a crystalline polyester resin.

In contrast, it has also been considered to enhance toner durability by providing an annealing step in the toner production process and inhibiting compatibility of a crystalline polyester resin by promoting crystallization of the crystalline polyester resin (see, for example, Japanese Patent Application Laid-open No. 2010-152102).

Although it is true that crystallization of a crystalline polyester resin can be promoted by an annealing step, due to the slow nucleation rate during crystallization, crystallization proceeds while the crystalline polyester resin aggregates, thereby resulting in an increased likelihood of the crystalline polyester resin being in a poorly dispersed state.

Due to the effects thereof, the charge on the surface of toner particles becomes disproportionate during triboelectric charging of the surface, the rate at which charging of the toner rises up ends up decreasing, and there may be increased likelihood of image fogging particularly in the case of continuous output of images having a high coverage rate.

In other words, since it was difficult for toners containing a crystalline polyester resin to realize both crystallinity and dispersibility of the crystalline polyester resin, it was also difficult to realize both toner durability and the rate at which charging rises up.

Furthermore, proposals have also been made to increase the crystallization rate of crystalline polyester resins by adding an inorganic crystal nucleating agent such as silica (see, for example, Japanese Patent Application Laid-open No. 2007-033773) or an organic crystal nucleating agent such as fatty acid amide (see, for example, Japanese Patent Application Laid-open No. 2006-113473).

However, even if these crystal nucleating agents are added, since opportunities for contact with the crystal nucleating agent are limited, crystalline polyester resin ends up remaining that has not crystallized as a result of not being acted on by the crystal nucleating agent, thereby limiting the effect of improving toner durability. In addition, the dispersibility of the crystalline polyester resin was also unable to be improved and the rate at which charging rises up easily became worse. On the other hand, proposals have also been made for improving the amorphous resin combined with the crystalline polyester resin. For example, the use of a hybrid resin containing amorphous resin in the form of a polyester unit and vinyl copolymer unit was proposed in order to improve low-temperature fixability (see, for example, Japanese Patent Application Laid-open No. 2003-173047).

However, due to the inadequate plasticization speed during fixation, further improvements were required for high-speed printing of images having a high coverage rate when using heavy paper.

In addition, since improvement of the crystallinity and dispersibility of the crystalline polyester resin in toner was inadequate, there were also problems with toner durability and the rate at which charging rises up.

As has been described above, a toner has yet to be obtained that is able to satisfy all requirements relating to low-temperature fixability, durability and the rate at which charging rises up during use of heavy paper.

SUMMARY OF THE INVENTION

An object of the present invention is to provide a toner that solves the above-mentioned problems.

In other words, an object of the present invention is to provide a toner having superior low-temperature fixability, durability and rate at which charging rises up during use of heavy paper.

The inventors of the present invention conducted extensive studies on toners containing a crystalline polyester resin and amorphous resin in order to provide a toner capable of solving the above-mentioned problems.

As a result, it was determined that a toner is required that satisfies the three requirements of plasticization speed by the crystalline polyester resin during fixation (low-temperature fixability), crystallinity of the crystalline polyester resin in the toner (durability) and dispersibility (rate at which charging rises up).

However, when plasticization speed during fixation is attempted to be increased, crystallization of the crystalline polyester resin decreases and it becomes difficult to eliminate plasticization at normal temperatures, while when crystallinity is attempted to be increased by means such as annealing treatment, since this leads to poor dispersibility of the crystalline polyester resin, the problem was difficult to solve.

The inventors of the present invention, while taking these problems into consideration, first focused on improving the crystallinity of the crystalline polyester resin.

The inventors of the present invention found that by bonding a crystal nucleating agent segment to the end of the polyester molecular chain of a crystalline polyester, the crystal nucleating agent demonstrates nucleating effects, thereby making it possible to improve crystallinity of the crystalline polyester.

However, it was still difficult to improve dispersibility of the crystalline polyester resin by this alone. In addition, the problem of plasticization speed during fixation still remained.

Therefore, although studies were conducted on introducing a segment having a dispersing effect on the crystalline polyester resin from the viewpoint of improving dispersibility, there were many cases in which crystallinity of the crystalline polyester resin was conversely impaired.

As a result of proceeding with additional studies, the inventors of the present invention arrived at the idea of imparting the previously described crystal nucleating agent with not only a nucleating effect, but also a dispersing effect in order to allow a dispersing effect to be demonstrated without impairing crystallinity of the crystalline polyester resin.

The inventors of the present invention also succeeded at allowing both a nucleating effect and dispersing effect to be demonstrated by the crystal nucleating agent segment by using a specific amorphous resin, and also found that the plasticization speed by the crystalline polyester resin during fixation is increased and enables the imparting of a so-called plasticizing effect, thereby leading to completion of the present invention.

Namely, the present invention relates to a toner having toner particle containing a crystalline polyester resin A, an amorphous resin B and a colorant, wherein (1) the crystalline polyester resin A is a resin that has a crystal nucleating agent segment (D) on the end of a polyester molecular chain (C), (2) the amorphous resin (B) is a hybrid resin in which a polyester unit (E) and a vinyl polymer unit (F) are chemically bonded, and (3) when the SP value of the polyester molecular chain (C) is defined as Sc $((cal/cm^3)^{1/2})$, the SP value of the crystal nucleating agent segment (D) is defined as Sd $((cal/cm^3)^{1/2})$, the SP value of the polyester unit (E) is defined as Se $((cal/cm^3)^{1/2})$, and the SP value of the vinyl polymer unit (F) is defined as Sf $((cal/cm^3)^{1/2})$, then the Sc, the Sd, the Se and the Sf satisfy the following expressions 1 to 3.

$$|Sd-Sf|<|Sd-Se| \quad \text{(Expression 1)}$$

$$|Sd-Sf|\leq 1.00 \quad \text{(Expression 2)}$$

$$|Sc-Se|<|Sc-Sf| \quad \text{(Expression 3)}$$

According to the present invention, a toner can be provided that has superior low-temperature fixability, durability and rate at which charging rises up when using heavy paper.

Further features of the present invention will become apparent from the following description of exemplary embodiments (with reference to the attached drawings).

BRIEF DESCRIPTION OF THE DRAWING

FIG. 1 is a schematic diagram showing a state in which a crystalline polyester resin A is microscopically present in the toner of the present invention.

DESCRIPTION OF THE EMBODIMENTS

SP value $((cal/cm^3)^{1/2})$ is a solubility parameter that indicates the ease with which two substances having similar SP values (having a small absolute value for the difference in SP values) have affinity.

Furthermore, SP values used in the present invention are calculated from the type of constituent monomer and molar ratio thereof according to a commonly used method of which some are described in Fedors (Poly. Eng. Sci., 14(2), 147 (1974)).

The present invention is characterized in that, the state in which a crystalline polyester resin A is microscopically present in a toner is controlled by having SP values of components contained in the toner satisfy specific relationships.

FIG. 1 schematically shows a state in which the crystalline polyester resin A is microscopically present in a toner that satisfies the requirements of the present invention. The present invention is naturally not limited by FIG. 1.

In FIG. 1, C and D respectively represent a polyester molecular chain (C) and crystal nucleating agent segment (D)

of the crystalline polyester resin A. E and F respectively represent a polyester unit (E) and a vinyl polymer unit (F) of the amorphous resin B.

Since the amorphous resin B of the present invention is a hybrid resin in which the polyester unit (E) and the vinyl polymer unit (F) are chemically bonded, it is a macroscopically uniform resin.

However, in the case of viewing microscopically, since the molecular structures of the polyester unit (E) and the vinyl polymer unit (F) are different, each unit easily auto-aggregates and has a so-called micro-phase-separated structure.

In the present invention, in the micro-phase-separated structure, the phase attributable to the polyester unit (E) is referred to as the E phase and the phase attributable to the vinyl polymer unit (F) is referred to as the F phase.

The toner of the present invention is characterized in that, the polyester molecular chain (C) of the crystalline polyester resin A is allowed to easily be present in the E phase as shown in FIG. 1 with respect to the micro-phase-separated structure of the amorphous resin B, while the crystal nucleating agent segment (D) of the crystalline polyester resin A is allowed to easily be present in the F phase.

As a result of being present in this manner, the polyester molecular chain (C) not only plasticizes the polyester unit (E) during fixation, but the crystal nucleating agent segment (D) plasticizes the vinyl polymer unit (F), enabling a plasticizing effect to be demonstrated by the crystal nucleating agent segment (D).

Moreover, a synergistic effect is also demonstrated whereby corresponding plasticized units mutually induce molecular motion.

Consequently, the entire binding resin is plasticized instantaneously during fixation, and due to uniform sharp melting, the resulting toner has superior low-temperature fixability when using heavy paper, thereby making this preferable.

In addition, as a result of allowing the crystal nucleating agent segment (D) to be present in the F phase, the nucleating effect of the crystal nucleating agent segment (D) is enhanced, thereby making it possible to improve the crystallinity of the crystalline polyester resin A in the toner. Consequently, the resulting toner has superior durability in which plasticization at normal temperatures is inhibited, thereby making this preferable.

Although the reason for enhancement of the nucleating effect is uncertain, it is probably thought to be because, since the vinyl polymer unit (F) contains a larger number of side chains in the molecular structure thereof in comparison with the polyester unit (E), it has greater free volume. In other words, in the case the crystal nucleating agent segment (D) is present in the F phase having a large free volume, the nucleating molecular motion of the crystal nucleating agent segment (D) is presumed to allow nucleation to be completed quickly with little interference by the molecular chain of the amorphous resin B.

Moreover, as a result of there being high affinity between the crystal nucleating agent segment (D) and the vinyl polymer unit (F), a dispersing effect is demonstrated by the crystal nucleating agent segment (D). As a result, dispersibility of the crystalline polyester resin A can be improved, and the resulting toner has a superior rate at which charging rises up, thereby making this preferable.

The reason for a dispersing effect being demonstrated by the crystal nucleating agent segment (D) is presumed to probably be due to the ease of adopting a crystalline structure as a result of the crystalline polyester resin A being oriented at the interface of the micro-phase-separated structure as the crystal nucleating agent segment (D) becomes increasingly finely dispersed in the F phase.

Furthermore, although the reason for the increase in the rate at which charging rises up due to the favorable dispersibility of the crystalline polyester resin in the toner is uncertain, it is thought by the inventors of the present invention to be as indicated below.

In the case the crystalline polyester resin has favorable dispersibility, the crystalline polyester resin is finely dispersed on the surface of toner particles, and this is thought to result in a large contact area between the amorphous resin and the crystalline polyester resin. At this time, the crystalline polyester resin, having lower electrical resistance in comparison with the amorphous resin, demonstrates an action that enhances the rate at which charge is transferred on the surface of the toner particles, and this is presumed to enable the surface charge of the toner particles to rapidly become uniform.

Furthermore, in the case the crystalline polyester resin has inferior dispersibility, the contact area between the crystalline polyester resin and amorphous resin on the surface of toner particles decreases. Consequently, transfer of charge between the crystalline polyester resin and amorphous resin no longer proceeds smoothly and the surface charge of the toner particles becomes disproportionate, which leads to a decrease in the rate at which charging rises up of the toner, thereby making this undesirable.

The toner of the present invention is required to satisfy the following expression when the SP value of the polyester molecular chain (C) is defined as Sc ($(cal/cm^3)^{1/2}$), the SP value of the crystal nucleating agent segment (D) is defined as Sd ($(cal/cm^3)^{1/2}$), the SP value of the polyester unit (E) is defined as Se ($(cal/cm^3)^{1/2}$), and the SP value of the vinyl polymer unit (F) is defined as Sf ($(cal/cm^3)^{1/2}$).

$$|Sd-Sf|<|Sd-Se| \quad \text{(Expression 1)}$$

Expression 1 is a relational expression indicating that the SP value of the crystal nucleating agent segment (D) (Sd) is relatively closer to the SP value of the vinyl polymer unit (F) (Sf) of the amorphous resin B than the SP value of the polyester unit (E) (Se).

As a result of satisfying the relationship of Expression 1, the crystal nucleating agent segment (D) has affinity for and is relatively attracted to the vinyl polymer unit (F) of the amorphous resin B, and is easily present in the phase attributable to the vinyl polymer unit (F) (F phase).

As a result, the previously described plasticizing effect, nucleating effect and dispersing effect are able to be demonstrated due to interaction between the crystal nucleating agent segment (D) and the vinyl polymer unit (F).

On the other hand, in the case of not satisfying Expression 1, the crystal nucleating agent segment (D) ends up being easily incorporated in the phase attributable to the polyester unit (E) (E phase). Consequently, the plasticizing effect, nucleating effect and dispersing effect are unable to be adequately demonstrated, and the resulting toner has inferior low-temperature fixability, durability and rate at which charging rises up when using heavy paper, thereby making this undesirable.

The SP values of each of the units C, D, E and F can be controlled by selecting the type of monomer used and the content thereof. The SP value of the monomer tends to increase the greater the polarity thereof. The amount used of a monomer having a high SP value may be increased, for example, in order to raise the SP value. On the other hand, the amount used of a monomer having a low SP value may be increased, for example, in order to lower the SP value.

In addition, although there are no particular limitations thereon, from the viewpoint of obtaining a toner having favorable low-temperature fixability and durability when using heavy paper, it is preferably such that $$0.60 \leq |Sd-Se|-|Sd-Sf| \leq 1.60,$$

and more preferably such that $$0.80 \leq |Sd-Se|-|Sd-Sf| \leq 1.40.$$

The greater the value of |Sd−Se|−|Sd−Sf|, the greater the degree to which the crystal nucleating agent segment (D) is relatively repelled by the polyester unit (E), and this value serves as an indicator of affinity with the vinyl polymer unit (F).

As a result of |Sd−Se|−|Sd−Sf| being 0.60 or more, the crystal nucleating agent segment (D) is able to be stably present in the phase attributable to the vinyl polymer unit (F) (F phase) as a result of being suitably repelled by the polyester unit (E).

Consequently, the resulting toner is such that the nucleating effect thereof is enhanced, crystallinity of the crystalline polyester resin A can be improved, and durability is favorable, thereby making this preferable.

On the other hand, as a result of |Sd−Se|−|Sd−Sf| being 1.60 or less, the polyester molecular chain (C) is easily present in the E phase without the crystal nucleating agent segment (D) being excessively repelled by the polyester unit (E) during fixation.

Consequently, the plasticization rate of the polyester unit (E) by the polyester molecular chain (C) increases, the binder resin is able to uniformly melt sharply, and the resulting toner has favorable low-temperature fixability even in images having a high coverage rate used with heavy paper or in graphic applications, thereby making this preferable.

The toner of the present invention is required to satisfy the relationship of the following Expression 2.

$$|Sd-Sf| \leq 1.00 \quad \text{(Expression 2)}$$

Expression 2 indicates that there is high affinity between the crystal nucleating agent segment (D) and the vinyl polymer unit (F).

In the case of a toner that does not satisfy Expression 2, since affinity between the crystal nucleating agent segment (D) and vinyl polymer unit (F) is excessively low, the crystal nucleating agent segment (D) is unable to adequately plasticize the vinyl polymer unit (F) during fixation. Consequently, low-temperature fixability when using heavy paper is inferior, thereby making this undesirable. In addition, since the crystal nucleating agent segment (D) is unable to be finely dispersed in the phase attributable to the vinyl polymer unit (F) (F phase), the dispersibility of the crystalline polyester resin A ends up decreasing and the resulting toner has an inferior rate at which charging rises up, thereby making this undesirable.

The value of |Sd−Sf| is more preferably 0.50 or less from the viewpoint of improving low-temperature fixability and the rate at which charging rises up when using heavy paper.

Moreover, the toner of the present invention is also required to satisfy the relationship of the following Expression 3.

$$|Sc-Se| < |Sc-Sf| \quad \text{(Expression 3)}$$

Expression 3 is a relational expression indicating that the SP value of the polyester molecular chain (C) (Sc) is relatively closer to the SP value of the polyester unit (E) (Se) of the amorphous resin B than the SP value of the vinyl polymer unit (F) (Sf).

As a result of satisfying the relationship of Expression 3, the polyester molecular chain (C) has affinity for and is attracted to the polyester unit (E) and is easily present in the phase attributable to the polyester unit (E) (E phase).

In the case of not satisfying the relationship of Expression 3, the polyester molecular chain (C) ends up being easily incorporated in the phase attributable to the vinyl polymer unit (F) (F phase).

Consequently, plasticization of the polyester unit (E) by the polyester molecular chain (C) during fixation is delayed, and low-temperature fixability when using heavy paper is inferior, thereby making this undesirable.

In addition, as a result of the polyester molecular chain (C) being incorporated in the phase attributable to the vinyl polymer unit (F) (F phase), a decrease in dispersibility results due to aggregation of the crystalline polyester resin A, and the resulting toner has an inferior rate at which charging rises up, thereby making this undesirable.

The toner of the present invention preferably satisfies the relationship of the following Expression 4 from the viewpoint of further improving uniformity of image gloss.

$$|Sc-Se| \leq 1.50 \quad \text{(Expression 4)}$$

The need for image gloss uniformity on the same printout continues to remain high in graphic applications. In particular, in the case images are present on the same printout having different toner laid-on levels, there are cases in which a difference in gloss occurs easily between the images.

As a result of satisfying the relationship of Expression 4, the toner of the present invention is able to provide a toner that has high image gloss uniformity even on images as described above.

As a result of satisfying Expression 4, affinity between the polyester molecular chain (C) and the polyester unit (E) of the amorphous resin B can be enhanced, thereby making it possible to improve the plasticizing speed of the polyester unit (E) by the polyester molecular chain (C) during fixation.

Consequently, even in the case images having different toner laid-on levels are present in the same printout, since a sharp melt property can be imparted without causing uneven viscosity between the images during fixation, the resulting toner has favorable image gloss uniformity, thereby making this preferable.

The value of |Sc−Se| is more preferably 1.00 or less from the viewpoint of obtaining a toner having even more superior image gloss uniformity.

The crystalline polyester resin A of the present invention is required to be a resin that has the crystal nucleating agent segment (D) on the end of the polyester molecular chain (C).

In the case the crystalline polyester resin A does not have the crystal nucleating agent segment (D) on the end of the polyester molecular chain (C), nucleating effect becomes extremely weak.

Consequently, since crystallinity of the crystalline polyester resin A becomes inferior and becomes compatible with and plasticizes the amorphous resin B at normal temperatures, the resulting toner has inferior durability, thereby making this undesirable.

In addition, a dispersing effect is not obtained from the crystal nucleating agent segment (D).

Consequently, the dispersibility of the crystalline polyester resin A decreases and the resulting toner has an inferior rate at which charging rises up, thereby making this undesirable.

In addition, since it becomes difficult to plasticize the vinyl polymer unit (F) of the amorphous resin B during fixation, low-temperature fixability when using heavy paper becomes inferior, thereby making this undesirable.

There are no particular limitations on the crystal nucleating agent segment (D) of the present invention provided it is a segment that is derived from a compound having a faster crystallization rate than the crystalline polyester resin A composed only of the polyester molecular chain (C).

However, from the viewpoint of being able to demonstrate a more stable nucleating effect, the crystal nucleating agent segment (D) is preferably a segment derived from a compound in which the main chain contains a hydrocarbon-based segment and has a functional group having a valence of 1 or more that is able to react with the end of the molecular chain of a crystalline polyester resin.

Among these, the crystal nucleating agent segment (D) is preferably a segment derived from either of an aliphatic monoalcohol having 10 to 30 carbon atoms and an aliphatic monocarboxylic acid having 11 to 31 carbon atoms from the viewpoint of obtaining a toner that has more favorable low-temperature fixability and durability when using heavy paper. The aliphatic monoalcohol more preferably has 14 to 30 carbon atoms and the aliphatic carboxylic acid more preferably has 15 to 31 carbon atoms.

Namely, the crystal nucleating agent segment (D) preferably has a structure in the crystalline polyester resin A in which the above-mentioned aliphatic monoalcohol and/or aliphatic monocarboxylic acid are condensed on the end of the polyester molecular chain (C).

If the crystal nucleating agent segment is a segment derived from an aliphatic monoalcohol having 10 or more carbon atoms and/or an aliphatic monocarboxylic acid having 11 or more carbon atoms, the nucleating rate thereof increases due to a higher degree of molecular chain regularity, and durability of the toner can be improved, thereby making this preferable.

On the other hand, if the crystal nucleating agent segment is a segment derived from an aliphatic monoalcohol having 30 carbon atoms or less and/or an aliphatic monocarboxylic acid having 31 carbon atoms or less, molecular mobility increases during thermal fusion and the vinyl polymer unit (F) is plasticized easily. Consequently, low-temperature fixability when using heavy paper can be further improved, thereby making this preferable.

Examples of aliphatic monoalcohols include 1-decanol, 1-dodecanol, 1-tetradecanol, 1-hexadecanol, 1-octadecanol, 1-docosanol, 1-octacosanol and 1-triacontanol.

Examples of aliphatic monocarboxylic acids include n-decanoic acid, n-dodecanoic acid (lauric acid), n-tetradecanoic acid (myristic acid), n-hexadecanoic acid (palmitic acid), n-octadecanoic acid (stearic acid), n-docosanoic acid (behenic acid), n-octacosanoic acid (montanic acid) and n-triacontanoic acid.

The molecular weight of the crystal nucleating agent segment (D) is preferably from 100 to 10,000 and more preferably from 150 to 5,000 from the viewpoint of realizing both reactivity with the end of the polyester molecular chain (C) and a nucleating effect.

The content of the crystal nucleating agent segment (D) with respect to all monomer-derived units composing the crystalline polyester resin A is preferably from 0.10 mol % to 7.00 mol %. If the content thereof is 0.10 mol % or more, the nucleating effect is enhanced and toner durability can be improved. The content thereof is more preferably 0.50 mol % or more. On the other hand, the content thereof is preferably 7.00 mol % or less, and more preferably 4.00 mol % or less, from the viewpoint of being able to inhibit auto-aggregation of the crystal nucleating agent segment (D) in the toner and enhancing dispersing effect to make it possible to improve the rate at which charging rises up of the toner.

Furthermore, the above-mentioned units refer to units derived from monomers used as copolymerization components when synthesizing the polyester molecular chain (C) and the crystal nucleating agent segment (D).

Whether or not the polyester molecular chain (C) and the crystal nucleating agent segment (D) are bonded in the crystalline polyester resin A can be determined according to the analysis described below.

2 mg of a sample are accurately weighed out followed by adding 2 mL of chloroform and dissolving to prepare a sample solution. Although the crystalline polyester resin A is used for the resin sample, in cases in which it is difficult to acquire the crystalline polyester resin A, toner containing the crystalline polyester resin A can be used as a sample instead. Next, 20 mg of 2,5-dihydroxybenzoic acid (DHBA) are accurately weighed out followed by adding 1 mL of chloroform and dissolving to prepare a matrix solution. In addition, after accurately weighing out 3 mg of sodium trifluoroacetate (NaTFA), 1 mL of acetone is added and the NaTFA is dissolved therein to prepare an ionization assistant solution.

25 μL of the sample solution, 50 μL of the matrix solution and 5 μL of the ionization assistant solution prepared in the manner described above are mixed and dropped onto a sample plate for use with an MALDI analyzer followed by drying to obtain a measurement sample. A MALDI-TOFMS system (Reflex III, Bruker Daltonics GmbH) is used for the analyzer to obtain a mass spectrogram. In the resulting mass spectrogram, each peak of the oligomer region (m/Z of 2000 or less) is assigned and confirmation is made as to whether or not a peak corresponding to a composition in which the crystal nucleating agent segment (D) is bonded to the end of the polyester molecular chain (C) is present.

There are no particular limitations on the SP value of the crystal nucleating agent segment (D) of the present invention (Sd) ($(cal/cm^3)^{1/2}$) provided the above-mentioned Expressions 1 and 2 are satisfied. However, (Sd) is preferably 8.20 to 9.00 from the viewpoint of being able to demonstrate the nucleating effect of the crystal nucleating agent segment (D), the dispersing effect and the plasticizing effect in the proper balance.

There are no particular limitations on the polyester molecular chain (C) that composes the crystalline polyester resin A of the present invention provided it satisfies the above-mentioned Expressions 1 and 3 and allows the crystalline polyester resin A to demonstrate crystallinity.

The following provides an explanation of preferable raw material monomers of the polyester molecular chain (C).

An aliphatic diol having 4 to 18 carbon atoms is preferably used for an alcohol component used as a raw material monomer of the polyester molecular chain (C) from the viewpoint of enhancing crystallinity. Among these, an aliphatic diol having 6 to 12 carbon atoms is preferable from the viewpoint of easily enhancing low-temperature fixability, durability and the rate at which charging rises up of the toner. Examples of aliphatic diols include 1,6-hexanediol, 1,7-heptanediol, 1,8-octanediol, 1,9-nonanediol, 1,10-decanediol, 1,11-undecanediol and 1,12-dodecanediol. The content of the above-mentioned aliphatic diol is preferably 80.0 mol % to 100.0 mol %, more preferably 90.0 mol % to 100.0 mol %, and even more preferably 95.0 mol % to 100.0 mol % of the alcohol component from the viewpoint of further enhancing crystallinity of the crystalline polyester resin A.

The alcohol component used as a raw material monomer of the polyester molecular chain (C) may also include a polyvalent alcohol component in addition to the above-mentioned aliphatic diol.

Examples thereof include aromatic diols such as alkylene oxide adducts of bisphenol A represented by the following formula (I) such as a polyoxypropylene adduct of 2,2-bis(4-hydroxyphenyl)propane or a polyoxyethylene adduct of 2,2-bis(4-hydroxyphenyl)propane, and alcohols having a valence of 3 or more such as glycerin, pentaerythritol or trimethylolpropane.

[Chemical Formula 1]

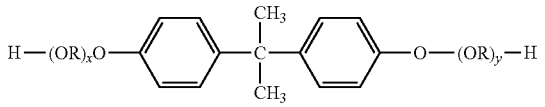

(I)

(In the above formula, R represents an alkylene group having 2 or 3 carbon atoms, x and y represent positive numbers, and the sum of x and y is 1 to 16 and preferably 1.5 to 5.)

An aliphatic dicarboxylic acid compound having 4 to 18 carbon atoms is preferably used for a carboxylic acid component used as a raw material monomer of the polyester molecular chain (C). Among these, an aliphatic dicarboxylic acid compound having 6 to 12 carbon atoms is preferable from the viewpoint of easily enhancing low-temperature fixability, durability and the rate at which charging rises up of the toner. Examples of aliphatic dicarboxylic acid compounds include 1,8-octanedioic acid, 1,9-nonanedioic acid, 1,10-decanedioic acid, 1,11-undecanedioic acid and 1,12-dodecanedioic acid.

The content of the aliphatic dicarboxylic acid compound having 6 to 18 carbon atoms is preferably 80.0 mol % to 100.0 mol %, more preferably 90.0 mol % to 100.0 mol %, and even more preferably 95.0 mol % to 100.0 mol % of the carboxylic acid component from the viewpoint of further enhancing crystallinity of the crystalline polyester resin A.

The carboxylic acid component for obtaining the polyester molecular chain (C) may also include a carboxylic acid component in addition to the above-mentioned aliphatic dicarboxylic acid compound. Examples thereof include, but are not limited to, aromatic dicarboxylic acid compounds and aromatic polyvalent carboxylic acid compounds having a valence of 3 or more. Derivatives of aromatic dicarboxylic acids are included in aromatic dicarboxylic acid compounds. Specific examples of aromatic dicarboxylic acid compounds preferably include aromatic dicarboxylic acids such as phthalic acid, isophthalic acid or terephthalic acid, acid anhydrides thereof and alkyl (1 to 3 carbon atoms) esters thereof. Examples of alkyl groups in the alkyl esters include a methyl group, ethyl group, propyl group and isopropyl group. Examples of polyvalent carboxylic acid compounds having a valence of 3 or more include aromatic carboxylic acid such as 1,2,4-benzenetricarboxylic acid (trimellitic acid), 2,5,7-naphthalenetricarboxylic acid, pyromellitic acid and derivatives thereof such as acid anhydrides thereof or alkyl (1 to 3 carbon atoms) esters thereof.

The polyester molecular chain (C) of the crystalline polyester resin A of the present invention is able to induce crystallization during toner formation the higher the crystallinity thereof, and is also able to improve toner durability, thereby making this preferable. Consequently, the polyester molecular chain (C) is preferably obtained by condensation polymerization of a saturated aliphatic diol and a saturated aliphatic dicarboxylic acid.

The molar ratio between the raw material monomers of the polyester molecular chain (C) in the form of an alcohol component and carboxylic acid component (carboxylic acid component/alcohol component) is preferably 0.70 to 1.30. If this ratio is within the above-mentioned range, the amorphous resin B can be easily obtained having a desired molecular weight and acid value, thereby making this preferable.

There are no particular limitations on the SP value of the polyester molecular chain (C) of the present invention (Sc) provided it satisfies the relationship of Expression 3. However, the SP value (Sc) is preferably 9.00 to 11.50 from the viewpoint of easily obtaining a toner having more favorable durability and rate at which charging rises up.

More specifically, as a result of (Sc) being 9.00 or more, since the polyester molecular chain (C) has a suitable number of polar groups, charge retention capacity of the crystalline polyester resin A is enhanced. Consequently, the rate at which charging rises up of the toner is easily improved, thereby making this preferable.

On the other hand, as a result of (Sc) being 11.50 or less, the number of polar groups of the polyester molecular chain (C) decreases, and since this results in a highly ordered molecular chain, crystallinity of the crystalline polyester resin A increases. Consequently, the durability of the toner is easily improved, thereby making this preferable.

The weight-average molecular weight of the crystalline polyester resin A of the present invention (MwA) is preferably 8000 to 100,000 and more preferably 12,000 to 45,000 from the viewpoints of low-temperature fixability and durability of the toner.

The acid value of the crystalline polyester resin A is preferably 2 mgKOH/g to 40 mgKOH/g from the viewpoints of the rate at which charging rises up and charge stability.

The crystalline polyester resin A used in the present invention has crystallinity. Consequently, it has an endothermic peak when heated during measurement with a differential scanning calorimeter (DSC).

Although there are no particular limitations thereon, the heat of fusion (AH) as determined from the area of the endothermic peak is preferably 80 J/g to 160 J/g from the viewpoints of toner low-temperature fixability and durability. The melting point of the crystalline polyester resin A is preferably 60° C. to 120° C. and more preferably 70° C. to 90° C. from the same viewpoints.

The amorphous resin B of the present invention is required to be a hybrid resin in which the polyester unit (E) and the vinyl polymer unit (F) are chemically bonded.

In the case the amorphous resin B is a polyester resin composed of the polyester unit (E) without containing the vinyl polymer unit (F), since the previously described nucleating effect and dispersing effect attributable to interaction between the vinyl polymer unit (F) and the crystal nucleating agent segment (D) are not demonstrated, the resulting toner has inferior durability and rate at which charging rises up, thereby making this undesirable.

In addition, in the case the amorphous resin B is a vinyl polymer resin composed of the vinyl polymer unit (F) without containing the polyester unit (E), the previously described micro-phase-separated structure cannot be formed. Consequently, since the previously described plasticizing effect and dispersing effect attributable to interaction between the micro-phase-separated structure and the crystal nucleating agent segment (D) are not demonstrated, the resulting toner has inferior low-temperature fixability and rate at which charging rises up when using heavy paper, thereby making this undesirable.

In addition, in the case the amorphous resin B merely contains the vinyl polymer unit (F) and the polyester unit (E) without the vinyl polymer unit (F) and the polyester unit (E) being chemically bonded, the above-mentioned micro-phase-separated structure is unable to be formed.

Consequently, since the previously described plasticizing effect and dispersing effect attributable to interaction between the micro-phase-separated structure and the crystal nucleating agent segment (D) are not demonstrated, the resulting toner has inferior low-temperature fixability and rate at which charging rises up when using heavy paper, thereby making this undesirable.

Although the vinyl polymer unit (F) may be a vinyl homopolymer unit or vinyl copolymer unit, it is preferably a vinyl copolymer unit.

In addition, although there are no particular limitations thereon, the dispersing effect attributable to the crystal nucleating agent segment (D) is greater the greater the stability and ease of formation of the micro-phase-separated structure by the amorphous resin B, thereby making this preferable. From this viewpoint, the amorphous resin B is preferably a resin that contains a block copolymer and/or graft copolymer of the polyester unit (E) and the vinyl polymer unit (F).

Furthermore, the amorphous resin B of the present invention may also contain a polyester unit (E) that is not bonded to the vinyl polymer unit (F) or a vinyl polymer unit (F) that is not bonded to the polyester unit (E).

In addition, from the viewpoint of being able to stably form the micro-phase-separated structure, the SP value of the polyester unit (E) (Se) and the SP value of the vinyl polymer unit (F) (Sf) are preferably suitably separated. Consequently, the absolute value of the difference between Se and Sf in the form of $|Se-Sf|$ is preferably 0.40 or more and more preferably 0.80 or more. On the other hand, the upper limit thereof is preferably 2.00 or less and more preferably 1.50 or less.

The mass ratio between the polyester unit (E) and the vinyl polymer unit (F) in the amorphous resin B is preferably such that the ratio of polyester unit (E):vinyl polymer unit (F) is preferably 55:45 to 95:5 and more preferably 60:40 to 90:10.

In the case the content of the vinyl polymer unit (F) exceeds 45% by mass, the vinyl polymer unit (F) may not be adequately plasticized by the crystal nucleating agent segment (D) during fixation. Consequently, the content of the vinyl polymer unit (F) is preferably 45% by mass or less from the viewpoint of improving low-temperature fixability with respect to images having a high coverage rate.

On the other hand, in the case the content of the vinyl polymer unit (F) is less than 5% by mass, since the amount of vinyl polymer unit (F) able to interact with the crystal nucleating agent segment (D) is low, dispersibility of the crystalline polyester resin A may be inadequate. Consequently, the content of the vinyl polymer unit (F) is preferably 5% by mass or more from the viewpoints of improving the rate at which charging rises up of the toner and being able to reduce image fogging during continuous output of images having a high coverage rate.

Examples of vinyl monomers for forming the vinyl polymer unit (F) of the amorphous resin B of the present invention include the following styrene monomers and acrylic acid monomers, and one type can be used or a plurality of types can be used in combination.

Examples of styrene monomers include styrene and o-methylstyrene. In addition, examples of acrylic acid monomers include acrylic acid, methacrylic acid and ester derivatives thereof.

Examples of ester derivatives of acrylic acid include those in which the hydrogen atom of the carboxyl group of acrylic acid is substituted with an alkyl group or alkenyl group having 1 to 50 carbon atoms.

Examples thereof include methyl acrylate, n-butyl acrylate, 2-ethylhexyl acrylate, n-lauryl acrylate, n-stearyl acrylate, n-behenyl acrylate, n-tetracosyl acrylate, n-hexacosyl acrylate, n-octacosyl acrylate, n-triacontyl acrylate, cyclohexyl acrylate and tertiary-butyl acrylate.

In addition, examples of ester derivatives of methacrylic acid include those in which the hydrogen atom of the carboxyl group of methacrylic acid is substituted with a linear alkyl group and/or cyclic alkyl group or alkenyl group having 1 to 50 carbon atoms.

Specific examples thereof include methyl methacrylate, n-butyl methacrylate, 2-ethylhexyl methacrylate, n-lauryl methacrylate, n-stearyl methacrylate, n-behenyl methacrylate, n-tetracosyl methacrylate, n-hexacosyl methacrylate, n-octacosyl methacrylate, n-triacontyl methacrylate, cyclohexyl methacrylate and tertiary-butyl methacrylate.

The above-mentioned vinyl polymer unit (F) may also be a unit produced using a polymerization initiator. A known polymerization initiator indicated below is used for the above-mentioned polymerization initiator.

Examples thereof include
2,2'-azobisisobutyronitrile,
2,2'-azobis(4-methoxy-2,4-dimethylvaleronitrile) and
2,2'-azobis(2,4-dimethylvaleronitrile).

These initiators are preferably used at 0.05 parts by mass to 10 parts by mass based on 100 parts by mass of monomer from the viewpoint of polymerization efficiency.

The amorphous resin B in the present invention is a hybrid resin in which the polyester unit (E) and the vinyl polymer unit (F) are chemically bonded.

Consequently, polymerization is carried out using a compound capable of reacting with any of the raw material monomers of both units (to be referred to as a "bireactive compound").

Examples of such bireactive compounds include compounds such as fumaric acid, acrylic acid, methacrylic acid, citraconic acid, maleic acid or dimethyl fumarate included among the above-mentioned monomers of condensation polymerization resins and monomers of addition polymerization resins. Among these, fumaric acid, acrylic acid and methacrylic acid are used preferably.

The amount of bireactive compound used is 0.1% by mass to 20% by mass and preferably 0.2% by mass to 10.0% by mass in all of the raw material monomers.

There are no particular limitations on the SP value of the vinyl polymer unit (F) of the present invention (Sf) ($(cal/cm^3)^{1/2}$) provided it satisfies the above-mentioned Expressions 1 to 3.

However, Sf preferably satisfies the relationship of the following Expression 5 from the viewpoints of obtaining a toner having favorable charge stability, inhibiting the formation of toner having a low charge due to charge relaxation even in the case of standing at a high temperature and high humidity, and improving image fogging.

$$Sf \leq 9.00 \quad \text{(Expression 5)}$$

Sf is more preferably 8.90 or less and even more preferably 8.85 or less.

Although the SP value (Sf) is a solubility parameter, in the case of considering molecular structure, a higher SP value corresponds to the containing of a larger number of polar groups. Consequently, as the SP value (Sf) decreases, the adsorption of water by polar groups of the vinyl polymer unit (F) is inhibited, and this is presumed to make it possible to inhibit charge relaxation due to standing.

Furthermore, although there are no particular limitations on the lower limit of the SP value (Sf), it is preferably 8.20 or more from the viewpoint of controlling saturation charge quantity of the toner.

Furthermore, the SP value (Sf) of the vinyl polymer unit (F) of the amorphous resin B of the present invention is a value that includes the above-mentioned bireactive compound.

Although there are no particular limitations on the polyester unit (E) of the present invention provided it satisfies Expressions 1 and 3, the following provides an explanation of a preferable aspect thereof.

The following provides an explanation of raw material monomers preferably used for the polyester unit (E) of the present invention.

Examples of bivalent alcohol components that can be used include alkylene oxide adducts of bisohenol A represented by the above-mentioned formula (I) such as a polyoxypropylene adduct of 2,2-bis(4-hydroxyphenyl)propane or a polyoxyethylene adduct of 2,2-bis(4-hydroxyphenyl)propane, ethylene glycol, 1,3-propylene glycol and neopentyl glycol.

In addition, examples of alcohol components having a valence of 3 or more that can be used include sorbitol, pentaerythritol and dipentaerythritol.

One monomer or a plurality of monomers selected from these divalent alcohol components and polyvalent alcohol components having a valence of 3 or more can be used.

Examples of divalent carboxylic acid components used as an acid component include maleic acid, fumaric acid, phthalic acid, isophthalic acid, terephthalic acid, succinic acid, adipic acid, n-dodecenylsuccinic acid and acid anhydrides thereof or lower alkyl esters thereof.

Examples of polyvalent carboxylic acid components having a valence of 3 or more include 1,2,4-benzenetricarboxylic acid, 2,5,7-naphthalenetricarboxylic acid, pyromellitic acid, Empol trimer acids, acid anhydrides thereof and lower alkyl esters thereof.

Although there are no particular limitations on the method used to produce the polyester unit (E), it can be produced by an esterification reaction or transesterification reaction using each of the above-mentioned monomers.

When polymerizing the raw material monomers, a commonly used esterification catalyst such as dibutyltin oxide may be suitably used to accelerate the reaction.

There are no particular limitations on the SP value of the polyester unit (E) of the present invention (Se) ($(cal/cm^3)^{1/2}$) provided it satisfies Expressions 1 and 3.

However, Se is preferably 9.50 to 11.00 from the viewpoints of the rate at which charging rises up and charge stability of the resulting toner.

The glass transition temperature (Tg) of the amorphous resin B is preferably 45° C. to 75° C. from the viewpoints of durability and low-temperature fixability of the toner. The softening point of the amorphous resin B is preferably 80° C. to 150° C. from the same viewpoints.

The weight-average molecular weight of the amorphous resin B (Mwb) is preferably 8,000 to 1,200,000 and more preferably 40,000 to 300,000 from the viewpoints of durability and low-temperature fixability of the toner.

The acid value of the amorphous resin B is preferably 2 mgKOH/g to 40 mgKOH/g from the viewpoints of the rate at which charging rises up and charge stability of the toner.

In addition, in the toner particle according to the present invention, the mass ratio between the crystalline polyester A and the amorphous resin B is such that the ratio of crystalline polyester resin A:amorphous resin B is preferably 5:95 to 40:60 and more preferably 7:93 to 20:80.

As a result of the content of the crystalline polyester resin A being 5% by mass or more, the binder resin is easily plasticized during fixation and low-temperature fixability and uniform image gloss when using heavy paper are improved, thereby making this preferable. The content of the crystalline polyester resin A is more preferably 7% by mass or more.

On the other hand, as a result of the content of the crystalline polyester resin A being 40% by mass or less, the crystalline polyester resin A is able to be adequately crystallized during toner production, plasticization at normal temperatures is inhibited, and toner durability can be improved, thereby making this preferable. The content of the crystalline polyester resin A is more preferably 20% by mass or less.

In addition, the softening point of the toner is preferably 80° C. to 130° C. from the viewpoint of low-temperature fixability of the toner. The weight-average molecular weight Mw of the toner is preferably 3,000 to 120,000 from the viewpoints of fixing performance and hot offset.

In the present invention, a wax can be used as necessary in order to impart mold releasability to the toner.

Hydrocarbon-based wax in the manner of low molecular weight polyethylene, low molecular weight polypropylene, microcrystalline wax or paraffin wax is preferable from the viewpoints of ease of dispersion in the toner and high mold releasability. One type of wax may be used or two or more types may be used in combination in small amounts as necessary.

More specifically, examples of wax include VISKOL® 330-P, 550-P, 660-P or TS-200 (Sanyo Chemical Industries, Ltd.), Hi-WAX 400P, 200P, 100P, 410P, 420P, 320P, 220P, 210P or 110P (Mitsui Chemicals, Inc.), Sasol H1, H2, C80, C105 or C77 (Schumann Sasol GmbH), HNP-1, HNP-3, HNP-9, HNP-10, HNP-11 or HNP-12 (Nippon Seiro Co., Ltd.), UNILIN® 350, 425, 550 or 700, UNICID® 350, 425, 550 or 700 (Toyo ADL Corp.), Japan wax, bees wax, rice wax, candelilla wax and carnauba wax (available from Cerarica Noda Corp.).

The time at which the wax is added may be during melting and kneading during the course of toner production or during production of the amorphous resin B, and the addition method may be suitably selected from among known methods. In addition, these waxes may be used alone or may be used in combination.

The wax is preferably added at 1.0 part by mass to 20.0 parts by mass based on 100.0 parts by mass of the binder resin (total mass of the crystalline polyester resin A and the amorphous resin B).

The toner of the present invention may be a magnetic toner or non-magnetic toner. In the case of using a magnetic toner, a magnetic iron oxide is preferably used as colorant. Examples of magnetic iron oxides used include magnetite, maghemite and ferrite. In addition, the magnetic iron oxide is preferably first subjected to fragmentation treatment by applying shearing force to a slurry during production for the purpose of improving fine dispersibility in toner particles.

In the case the toner of the present invention is a magnetic toner, the amount of magnetic iron oxide contained (as colorant) in the toner is preferably 25% by mass to 45% by mass and more preferably 30% by mass to 45% by mass.

In the case of using as a non-magnetic toner, one type or two more types of carbon black or other conventionally known pigments or dyes can be used as colorant.

The added amount of colorant is preferably 0.1 parts by mass to 60.0 parts by mass and more preferably 0.5 parts by mass to 50.0 parts by mass based on 100.0 parts by mass of the binder resin (total mass of the crystalline polyester resin A and the amorphous resin B).

In addition, in the toner of the present invention, a flowability improver can be used as an inorganic fine powder that is highly effective in imparting flowability to the surface of toner particles.

A flowability improver that is capable of improving flowability in comparison with that prior to addition by externally adding to toner particles can be used for the flowability improver.

Examples thereof include fluorine-based resin powders in the manner of vinylidene fluoride fine powder or polytetrafluoroethylene fine powder, fine powdered silica in the manner of wet silica or dry silica, and treated silica obtained by subjecting this silica to surface treatment with a silane coupling agent, titanium coupling agent or silicone oil. The flowability improver is preferably a fine powder formed by vapor phase oxidation of a silicon halide compound that is referred to as dry silica or fumed silica. For example, this is formed using a pyrolytic oxidation reaction of silicon tetrachloride gas in the presence of oxygen and hydrogen, and the reaction formula thereof is as indicated below.

$$SiCl_4+2H_2+O_2 \rightarrow SiO_2+4HCl$$

In addition, in this production process, a compound fine powder of silica and other metal oxide may also be used that is obtained by using another metal halide compound in the manner of aluminum chloride or titanium chloride together with the silicon halide compound.

Moreover, a silica fine powder obtained by subjecting silica fine powder, formed by vapor phase oxidation of a silicon halide compound, to hydrophobic treatment is used preferably. The silica fine powder is particularly preferably treated so that the degree of hydrophobicity of the treated silica fine powder as determined by titrating according to a methanol titration test indicates a value within the range of 30 to 98.

Hydrophobicity is imparted by chemically treating with an organic silicon compound that reacts with or physically adsorbs to the silica fine powder. An example of a preferable method thereof consists of treating a silica fine powder formed by vapor phase oxidation of a silicon halide compound with an organic silicon compound. Examples of such organic silicon compounds include hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchorosilane, bromomethyldimethylchlorosilane, α-chloroethyltrichlorosilane, β-chloroethyltrichlorosilane, chloromethyldimethylchlorosilane, triorganosilylmercaptan, trimethylsilylmercaptan, triorganosilyl acrylate, vinyldimethylacetoxysilane, dimethylethoxysilane, dimethyldimethoxysilane, diphenyldiethoxysilane, 1-hexamethyldisiloxane, 1,3-divinyltetramethyldisiloxane, 1,3-diphenyltetramethyldisiloxane and dimethylpolysiloxanes having 2 to 12 siloxane units per molecule thereof and containing a hydroxyl group respectively bound per one Si in the units located on the ends thereof. One type of these can be used alone or two or more types can be used as a mixture.

The silica fine powder may be treated with silicone oil or may be treated in combination with the above-mentioned hydrophobic treatment.

Silicone oil having viscosity at 25° C. of 30 $mm^2/s$ to 1,000 $mm^2/s$ is preferably used for the silicone oil. Particularly preferable examples thereof include dimethyl silicone oil, methyl phenyl silicone oil, α-methylstyrene-modified silicone oil, chlorophenyl silicone oil and fluorine-modified silicone oil.

Examples of methods used to treat the silica fine powder with silicone oil include a method consisting of directly mixing silica fine powder treated with a silane coupling agent and silicone oil with a mixer in the manner of a Henschel mixer, a method consisting of spraying silicone oil onto silica fine powder serving as a base, and a method consisting of dissolving or dispersing silicone oil in a suitable solvent followed by adding silica fine powder, mixing and removing the solvent. Following treatment with silicone oil, the surface coating of the silicone oil-treated silica is more preferably stabilized by heating the silica in an inert gas to a temperature of 200° C. or higher (and more preferably 250° C. or higher).

An example of a preferable silane coupling agent is hexamethyldisilazane (HMDS).

In the present invention, treatment is preferably carried out using a method consisting of preliminarily treating the silica with a coupling agent followed by treating with silicone oil, or a method consisting of simultaneously treating with the coupling agent and silicone oil.

The inorganic fine powder is preferably used at 0.01 parts by mass to 8.00 parts by mass, and more preferably at 0.10 parts by mass to 4.00 parts by mass, based on 100.00 parts by mass of toner particle.

The toner of the present invention may also contain other additives as necessary. Examples thereof include a charging assistant, conductivity imparting agent, flowability imparting agent, caking preventive agent, release agent for use during hot roller fixation, lubricant, and resin fine particles or inorganic fine particles functioning as an abrasive.

Examples of lubricants include polyfluoroethylene powder, zinc stearate powder and polyvinylidene fluoride powder. Polyvinylidene fluoride powder is particularly preferable. Examples of abrasives include cerium oxide powder, silicon carbonate powder and strontium titanate powder. The toner of the present invention can be obtained by adequately mixing with these external additives using a mixer such as a Henschel mixer.

Although the toner of the present invention can be used as a single-component developer, it can also be used as a two-component developer by mixing with a magnetic carrier.

A commonly known magnetic carrier can be used for the magnetic carrier, and examples thereof include magnetic bodies such as surface-oxidized iron powder or non-oxidized iron powder, metal particles in the manner of iron, lithium, calcium, magnesium, nickel, copper, zinc, cobalt, manganese or rare earth metals and alloy particles and oxide particles thereof, or ferrite, and magnetic body-dispersed resin carriers containing a magnetic body and a binder resin retaining the magnetic body in a dispersed state (so-called resin carriers).

In the case of using the toner of the present invention as a two-component developer by mixing with a magnetic carrier, the mixing ratio of the magnetic carrier is preferably 2% by mass to 15% by mass as the toner concentration in the developer.

The method used to produce the toner of the present invention is preferably a production method that uses a pulverization method that includes a production step in which the crystalline polyester resin A and the amorphous resin B are melted and kneaded followed by solidifying by cooling.

Since the molecular chain of the crystalline polyester resin A is easily incorporated in the amorphous resin B as a result of mixing by applying shearing force during melting and kneading, previously described plasticizing effect, nucleating effect and dispersing effect attributable to interaction of the crystal nucleating agent segment (D) and the vinyl polymer unit (F) are easily demonstrated.

Consequently, the resulting toner has superior low-temperature fixability, durability and rate at which charging rises up when using heavy paper, thereby making this preferable.

In a raw material mixing step, materials that compose the toner particle in the form of the crystalline polyester resin A, the amorphous resin B, a colorant and other additives and the like as necessary are weighed out in prescribed amounts thereof, blended and mixed. Examples of mixing apparatuses used include a double cone mixer, V-mixer, drum mixer, Super mixer, Henschel mixer, Nauta mixer and Mechanohybrid mixer (manufactured by Nippon Coke & Engineering Co., Ltd.).

Next, the mixed materials are melted and kneaded to disperse the colorant and so on in a binder resin composed of the crystalline polyester resin A and the amorphous resin B. In the melting and kneading step, a batch-type kneading machines or continuous kneading machine can be used in the manner of a pressure kneader or Banbury mixer. A single-screw or twin-screw extruder is preferable based on its superiority of enabling continuous production. Examples thereof include the Model KTK Twin-Screw Extruder (Kobe Steel, Ltd.), Model TEM Twin-Screw Extruder (Toshiba Machine Co., Ltd.), PCM Kneader (Ikegai Corp.), Twin-Screw Extruder (KCK Co., Ltd.), Co-Kneader (Buss Corp.) and Kneadex (Nippon Coke & Engineering Co., Ltd.).

Moreover, a resin component obtained by melting and kneading is preferably rolled with a twin-roll mill and the like and then cooled with water and the like in a cooling step.

Next, the cooled resin component is pulverized to a desired particle diameter in a pulverizing step. In the pulverizing step, after coarsely pulverizing with a pulverizer in the manner of a crusher, hammer mill or feather mill, the cooled resin component is finely pulverized with, for example, a Kryptron System (Kawasaki Heavy Industries, Ltd.), Super Rotor (Nisshin Engineering Inc.), Turbo Mill (Freund-Turbo Corp.) or pulverizer using an air jet system.

Subsequently, the pulverized particles are sized using a classifier or sizing sieve in the manner of an Elbow Jet employing an internal classification system (Nittetsu Mining Co., Ltd.), Turbo Plex employing a centrifugal force classification system (Hosokawa Micron Co., Ltd.), TSP Separator (Hosokawa Micron Co., Ltd.) or Faculty (Hosokawa Micron Co., Ltd.) to obtain toner particles.

In addition, the toner particles can also be surface-treated in the manner of spheroidizing treatment as necessary following pulverization using a Hybridization System (Nara Machinery Co., Ltd.), Mechanofusion System (Hosokawa Micron Co., Ltd.), Faculty (Hosokawa Micron Co., Ltd.), or Meteorainbow MR Type (Nippon Pneumatic Mfg. Co., Ltd.).

Moreover, desired additives can be adequately mixed in as necessary with a mixer such as a Henschel mixer to obtain the toner of the present invention.

Furthermore, although there are no particular limitations thereon, an annealing step may be provided as necessary in any step during production of the toner of the present invention. The treatment temperature in the annealing step is preferably a temperature that is equal to or higher than the Tg of the toner and equal to or lower than the melting point of the crystalline polyester resin A. The treatment time is preferably within the range of 1 minute to 10,000 minutes.

The toner of the present invention is able to inhibit decreases in dispersibility of the crystalline polyester resin A, even if an annealing step is provided, due to the dispersing effect of the crystal nucleating agent segment (D) and the vinyl polymer unit (F) on the crystalline polyester resin A, thereby making this preferable.

Methods used to measure physical properties of the crystalline polyester resin A, the amorphous resin B and the toner of the present invention are as indicated below. The examples to be subsequently described are also based on these methods.

<Measurement of Weight-Average Molecular Weight by Gel Permeation Chromatography (GPC)>

A column is stabilized in a heat chamber at 40° C. and solvent in the form of tetrahydrofuran (THF) is passed through the column at this temperature at a flow rate of 1 mL/min followed by measuring after injecting about 100 μL of THF sample solution. In measuring the molecular weight of the sample, the molecular weight distribution of the sample is calculated from the relationship between the logarithmic value on a calibration curve prepared from several types of mono-dispersed polystyrene standard samples and a count value. Examples of standard polystyrene samples used to prepare the calibration curve include those having molecular weights of $10^2$ to $10^7$ manufactured by Tosoh Corp. or Showa Denko K.K., and the calibration curve is properly prepared by using standard polystyrene samples for at least about 10 points on the calibration curve. In addition, a refractive index (RI) detector is used for the detector. Furthermore, a plurality of commercially available polystyrene gel columns may be combined for use as the column, and examples thereof include combinations of Shodex GPC KF-801, 802, 803, 804, 805, 806, 807 or 800P manufactured by Showa Denko K.K., and combinations of TSKgel, G1000H($H_{XL}$), G2000H($H_{XL}$), G3000H($H_{XL}$), G4000H($H_{XL}$), G5000H($H_{XL}$), G6000H ($H_{XL}$), G7000H($H_{XL}$) or TSK Guard Column manufactured by Tosoh Corp.

In addition, the sample is prepared in the manner described below.

After placing the sample in THF and allowing to stand for several hours at 25° C., it is shaken well to thoroughly mix with the THF (until the sample no longer coalesces) followed by additionally allowing to stand undisturbed for 12 hours or more. At that time, the amount of time the sample is allowed to stand in the THF is 24 hours. Subsequently, the sample is passed through a sample treatment filter (using, for example, MyShori Disc H-25-2 (Tosoh Corp.) having a pore size of 0.2 μm to 0.5 μm) to obtain a GPC sample. In addition, the sample concentration is adjusted so that the resin component is contained at 0.5 mg/mL to 5.0 mg/mL.

<Measurement of Melting Point and Heat of Fusion of Crystalline Polyester Resin A and Wax>

The melting points of the crystalline polyester resin A and wax are determined by taking peak temperature of the maximum temperature of an endothermic peak on a DSC curve measured in compliance with ASTM D3418-82 using a differential scanning calorimeter (Q2000, TA Instruments, Inc.) to be the melting point, and taking the quantity of heat determined from peak area to be the heat of fusion.

Temperature correction of the detection unit is carried out using the melting points of indium and zinc, while correction of the quantity of heat is carried out using the heat of fusion of indium. More specifically, approximately 2 mg of sample are accurately weighed out and placed in an aluminum pan followed by measuring at a ramp rate of 10° C./min over a measuring temperature range of 30° C. to 200° C. using an empty aluminum pan as a reference. Furthermore, during measurement, the temperature is initially raised to 200° C. followed by lowering to 30° C. and then subsequently raising the temperature again. The maximum temperature of an endothermic peak on the DSC curve over a range of 30° C. to 200° C. during the second time the temperature is raised is taken to be the melting point and the quantity of heat determined from the peak area is taken to be the heat of fusion.

<Measurement of Tg of Amorphous Resin B and Toner>

Tg values of the amorphous resin B and toner are measured in compliance with ASTM D3418-82 using a differential scanning calorimeter (Q2000, TA Instruments, Inc.). Temperature correction of the detection unit is carried out using the melting points of indium and zinc, while correction of the quantity of heat is carried out using the heat of fusion of indium. More specifically, approximately 2 mg of sample are accurately weighed out and placed in an aluminum pan followed by measuring at a ramp rate of 10° C./min over a measuring temperature range of 0° C. to 180° C. using an empty aluminum pan as a reference. Furthermore, during measurement, the temperature is initially raised to 180° C. followed by lowering to 0° C. and then subsequently raising the temperature again. A change in specific heat is obtained over a temperature range of 0° C. to 100° C. during the second time the temperature is raised. The intersection between a line at the midpoint of the baseline before and after the change in specific heat and the differential scanning calorimetry curve is taken to be the glass transition temperature Tg of the amorphous resin B and toner.

<Measurement of Softening Point of Amorphous Resin B and Toner>

Measurement of softening point of the amorphous resin B and toner is carried out using a constant load extrusion type of tube type rheometer in the form of the Flow Tester CFT-500D Flow Characteristics Evaluation System (Shimadzu Corp.) in accordance with the manual provided with the system. In this system, a constant load is applied from above the measurement sample with a piston while heating the measurement sample filled into a cylinder and melting, followed by extruding the molten measurement sample from a die in the bottom of the cylinder to obtain a flow curve indicating the relationship between the amount the piston lowers and temperature at that time.

The "melting temperature as determined according to the ½ method", as described in the manual provided with the Flow Tester CFT-500D Flow Characteristics Evaluation System, is taken to be the softening point. Furthermore, the melting temperature according to the ½ method is calculated in the manner indicated below. First, ½ the difference between the amount the piston lowers (Smax) at the point the measurement sample has finished flowing out and the amount the piston lowers (Smin) at the point the measurement sample starts to flow out is determined (defined as X, wherein X=(Smax−Smin)/2). The temperature on the flow curve when the amount the piston lowers is equal to the sum of X and Smin on the flow curve is the melting temperature according to the ½ method.

A sample obtained by compression molding approximately 1.0 g of sample under the environment of the temperature at 25° C. for about 60 seconds at about 10 MPa using a tablet forming compressor (such as the NT-100H, NPA System Co., Ltd.) followed by forming into a cylindrical shape having a diameter of about 8 mm is used for the measurement sample.

The measurement conditions of the CFT-500D are indicated below.

Testing mode: Ramp method

Ramp rate: 4° C./min

Starting temperature: 50° C.

Saturated temperature: 200° C.

<Measurement of Acid Value of Crystalline Polyester Resin A, Amorphous Resin B and Toner>

Acid value is the number of mg of potassium hydroxide required to neutralize acid contained in 1 g of sample. Although the acid value of polyester resin is measured in compliance with JIS K 0070-1992, it is specifically measured in accordance with the procedure indicated below.

(1) Reagent Preparation 1.0 g of phenolphthalein is dissolved in 90 mL of ethyl alcohol (95 vol %) followed by the addition of ion exchange water to bring to a volume of 100 mL and obtain a phenolphthalein solution.

7 g of special grade potassium hydroxide are dissolved in 5 mL of water followed by the addition of ethyl alcohol (95 vol %) to bring to a volume of 1 L. The solution is placed in an alkali-resistant container while preventing contact with carbon dioxide gas and the like followed by allowing to stand for 3 days and then filtering to obtain a potassium hydroxide solution. The resulting potassium hydroxide solution is stored in an alkali-resistant container. The factor of the above-mentioned potassium hydroxide solution is determined by transferring 25 mL of 0.1 mol/l hydrochloric acid to an Erlenmeyer flask, adding several drops of the above-mentioned phenolphthalein solution, titrating with the above-mentioned potassium hydroxide solution, and determining the factor from the amount of potassium hydroxide solution required for neutralization. A hydrochloric acid solution prepared in compliance with JIS K 8001-1988 is used for the above-mentioned 0.1 mol/L hydrochloric acid.

(2) Procedure (A) Main Test 2.0 g of pulverized sample are accurately weighed out in a 200 mL Erlenmeyer flask followed by the addition of 100 mL of a mixed solution of toluene and ethanol (2:1) and dissolving over the course of 5 hours. Next, several drops of indicator in the form of the above-mentioned phenolphthalein solution are added followed by titrating using the above-mentioned potassium hydroxide solution. Furthermore, the titration endpoint is taken to be the point at which the feint vermillion color of the indicator persists for about 30 seconds.

(B) Blank Test

Titration is carried out using the same procedure as described above with the exception of not using the sample (namely, using only a mixed solution of toluene and ethanol (2:1)).

(3) Acid value is calculated by entering the results obtained into the equation indicated below.

$$A=[(C-B)\times f\times 5.61]/S$$

Here, A represents acid value (mgKOH/g), B represents the amount of potassium hydroxide solution added in the blank test (mL), C represents the amount of potassium hydroxide solution added in the main test (mL), f represents the factor of the potassium hydroxide solution, and S represents the amount of sample (g).

<Measurement of Weight-Average Particle Diameter (D4)>

Toner weight-average particle diameter (D4) is measured using a precision particle size distribution analyzer in the form of the Coulter Counter Multisizer 3® (Beckman Coulter Inc.), equipped with a 100 μm aperture tube and measuring based on the pore electrical resistance method, and dedicated software in the form of Beckman Coulter Multisizer 3 Version 3.51 (Beckman Coulter Inc.), provided with the system for setting measuring conditions and analyzing measurement data, at an effective number of measurement channels of 25,000 channels, followed by analysis of measurement data and calculation of results.

An electrolyte solution obtained by dissolving special grade sodium chloride in ion exchange water and adjusting to a concentration of about 1% by mass can be used for the electrolyte solution used during measurement, and an example thereof is Isoton II (Beckman Coulter Inc.).

Furthermore, the dedicated software is set as described below prior to measurement and analysis.

On the "Change standard operating method (SOM) screen" of the dedicated software, the total count of the control mode is set to 50,000 particles, the number of measurements is set to 1, and Kd value is set to the value obtained using "Standard 10.0 μm particles" (Beckman Coulter Inc.). Threshold and noise level are set automatically by pressing the threshold/noise level measurement button. In addition, the current is set to 1600 μA, the gain to 2, the electrolyte solution to Isoton II, and flushing of the aperture tube after measurement is checked.

On the "Pulse to particle diameter conversion setting screen" of the dedicated software, the bin interval is set to logarithmic particle diameter, particle diameter bin is set to the 256 particle diameter bin, and the particle diameter range is set to 2 μm to 60 μm.

The detailed measurement procedure is indicated below.

1. About 200 mL of the above-mentioned electrolyte solution are placed in a glass 250 mL round-bottom beaker for use with Multisizer 3, and the beaker is placed on the sample stand and then stirred with a stirrer rod in the counter-clockwise direction at 24 revolutions/second. Impurities and air bubbles in the aperture tube are then removed with the "Aperture flush" function of the analytical software.

2. 30 mL of the above-mentioned electrolyte solution are placed in a glass, 100 mL flat-bottom beaker followed by the addition of about 0.3 mL of a dispersing agent in the form of Contaminon N (10% by mass aqueous solution of neutral detergent for cleaning precision measuring instruments having a pH of 7 and composed of a nonionic surfactant, anionic surfactant and organic builder, manufactured by Wako Pure Chemical Industries Ltd.), which is diluted by a factor of 3 by mass with ion exchange water.

3. A prescribed amount of ion exchange water is placed in the water tank of an ultrasonic disperser in the form of the Ultrasonic Dispersion System Tetora 150 (Nikkaki Bios Co., Ltd.), having an electrical output of 120 W and equipped with two built-in oscillators having an oscillation frequency of 50 kHz with their respective phases shifted by 180 degrees, followed by adding about 2 mL of the above-mentioned Contaminon N to the water tank.

4. The beaker of step 2 is placed in the beaker mounting hole of the above-mentioned ultrasonic disperser and the ultrasonic disperser is operated. The height of the beaker is adjusted so that the surface of the electrolyte solution in the beaker reaches a state of maximum resonance.

5. About 10 mg of toner are added a little at a time to the above-mentioned electrolyte solution and dispersed therein while the electrolyte solution in the beaker of step 4 is irradiated with ultrasonic waves. Ultrasonic dispersion treatment is continued for an additional 60 seconds. Furthermore, during ultrasonic dispersion, the water temperature in the water tank is suitably adjusted so as to be from 10° C. to 40° C.

6. The aqueous electrolyte solution in which toner has been dispersed in step 5 is dropped into the round-bottom beaker placed on the sample stand in step 1 using a pipette and the measurement concentration is adjusted to about 5%. Measurement is carried out until the number of measured particles reaches 50,000.

7. Measurement data is analyzed with the above-mentioned dedicated software provided with the system followed by calculation of weight-average particle diameter (D4). Furthermore, the "average diameter" on the "Analysis/volume statistical values (arithmetic mean) screen" when set to "Graph/vol %" with the dedicated software is the weight-average particle diameter (D4).

Although the following provides a more detailed explanation of the present invention based on the following examples, embodiments of the present invention are not limited by these examples. Furthermore, the term "parts" in the examples represents "parts by mass".

EXAMPLES

<Production Example of Crystalline Polyester A1>

An alcohol monomer of the polyester molecular chain (C) in the form of 1,10-decanediol and an acid monomer in the form of 1,10-decanedioic acid were placed in a reaction tank equipped with a nitrogen inlet tube, moisture removal tube, stirrer and thermocouple in the blending ratio shown in Table 1.

0.8 parts by mass of a catalyst in the form of tin dioctanoate were added to 100 parts by mass as the total monomer mass followed by heating to 140° C. in a nitrogen atmosphere and reacting for 7 hours while distilling off water at normal pressure. Next, after reacting while raising the temperature to 200° C. at the rate of 10° C./hour and continuing to react for 2 hours after the temperature reached 200° C., the reaction was continued for 2 hours after reducing the pressure in the reaction tank to 5 kPa or less at 200° C.

Subsequently, the pressure in the reaction tank was gradually released and allowed to return to normal pressure followed by the addition of a monomer of the crystal nucleating agent segment (D) shown in Table 1 (1-octadecanol) and reacting for 1.5 hours at 200° C. under normal pressure. Subsequently, the pressure inside the reaction value was again reduced to 5 kPa or less at 200° C. followed by reacting for 2.5 hours at 200° C. to obtain crystalline polyester resin A1.

Various physical properties of the resulting crystalline polyester resin A1 are shown in Table 2.

A peak for a composition in which 1-octadecanol was bonded to the end of the polyester molecular chain (C) was confirmed in a MALDI-TOFMS mass spectrogram of the resulting crystalline polyester resin A1. On the basis thereof, the crystalline polyester resin A1 was confirmed to be a resin in which the crystal nucleating agent segment (D) is bonded to the end of the polyester molecular chain (C).

TABLE 1

| | Polyester molecular chain (C) | | | | | | | Crystal nucleating agent segment (D) | | | |
|---|---|---|---|---|---|---|---|---|---|---|---|
| | Sc | Alcohol component | SP value | Molar ratio | Acid component | SP value | Molar ratio | Sd | Monomer | No. of carbons | Molar ratio |
| A1 | 9.91 | 1,10-decanediol | 9.84 | 49.0 | 1,10-decanedioic acid | 9.97 | 49.0 | 8.82 | 1-octadecanol | 18 | 2.0 |
| A2 | 9.91 | 1,10-decanediol | 9.84 | 49.0 | 1,10-decanedioic acid | 9.97 | 49.0 | 8.40 | n-octadecanoic acid | 18 | 2.0 |
| A3 | 9.77 | 1,12-dodecanediol | 9.57 | 47.5 | 1,10-decanedioic acid | 9.97 | 47.5 | 8.51 | 1-triacontanol | 30 | 5.0 |
| A4 | 9.62 | 1,12-dodecanediol | 9.57 | 49.4 | 1,12-dodecanedioic acid | 9.66 | 49.4 | 8.92 | 1-hexadecanol | 16 | 1.2 |

TABLE 1-continued

| | Polyester molecular chain (C) | | | | | | | Crystal nucleating agent segment (D) | | | |
|---|---|---|---|---|---|---|---|---|---|---|---|
| | Sc | Alcohol component | SP value | Molar ratio | Acid component | SP value | Molar ratio | Sd | Monomer | No. of carbons | Molar ratio |
| A5 | 9.91 | 1,10-decanediol | 9.84 | 49.0 | 1,10-decanedioic acid | 9.97 | 49.0 | 8.97 | 1-pentadecanol | 15 | 2.0 |
| A6 | 10.34 | 1,12-dodecanediol | 9.57 | 49.0 | 1,6-hexanedioic acid | 11.10 | 49.0 | 8.97 | 1-pentadecanol | 15 | 2.0 |
| A7 | 10.34 | 1,12-dodecanediol | 9.57 | 49.0 | 1,6-hexanedioic acid | 11.10 | 49.0 | 8.82 | 1-octadecanol | 18 | 2.0 |
| A8 | 10.96 | 1,12-dodecanediol | 9.57 | 49.0 | Succinic acid | 12.35 | 49.0 | 8.25 | n-triacontanoic acid | 30 | 2.0 |
| A9 | 9.91 | 1,10-decanediol | 9.84 | 49.0 | 1,10-decanedioic acid | 9.97 | 49.0 | 8.25 | n-triacontanoic acid | 30 | 2.0 |
| A10 | 9.36 | 1,12-dodecanediol | 9.57 | 49.0 | 1,18-octadecanedioic acid | 9.14 | 49.0 | 8.97 | 1-pentadecanol | 15 | 2.0 |
| A11 | 10.25 | 1,6-hexanediol | 10.83 | 49.0 | 1,12-dodecanedioic acid | 9.66 | 49.0 | 8.25 | n-triacontanoic acid | 30 | 2.0 |
| A12 | 10.40 | 1,6-hexanediol | 10.83 | 49.0 | 1,10-decanedioic acid | 9.97 | 49.0 | 8.25 | n-triacontanoic acid | 30 | 2.0 |
| A13 | 11.10 | 1,10-decanediol | 9.84 | 49.0 | Succinic acid | 12.35 | 49.0 | 8.25 | n-triacontanoic acid | 30 | 2.0 |
| A14 | 11.34 | 1,10-decanediol | 9.84 | 49.0 | Fumaric acid | 12.83 | 49.0 | 8.25 | n-triacontanoic acid | 30 | 2.0 |
| A15 | 11.34 | 1,10-decanediol | 9.84 | 49.0 | Fumaric acid | 12.83 | 49.0 | 8.21 | n-hexatriacontanoic acid | 36 | 2.0 |
| A16 | 11.34 | 1,10-decanediol | 9.84 | 49.0 | Fumaric acid | 12.83 | 49.0 | 8.83 | n-octanoic acid | 8 | 2.0 |
| A17 | 11.34 | 1,10-decanediol | 9.84 | 49.97 | Fumaric acid | 12.83 | 49.97 | 8.21 | n-hexatriacontanoic acid | 36 | 0.06 |
| A18 | 11.34 | 1,10-decanediol | 9.84 | 46.3 | Fumaric acid | 12.83 | 46.3 | 8.83 | n-octanoic acid | 8 | 7.4 |
| A19 | 11.34 | 1,10-decanediol | 9.84 | 49.0 | Fumaric acid | 12.83 | 49.0 | 8.43 | 1-hexatriacontanol | 36 | 2.0 |
| A20 | 11.10 | 1,10-decanediol | 9.84 | 49.0 | Succinic acid | 12.35 | 49.0 | 9.69 | 1-octanol | 8 | 2.0 |
| A21 | 9.77 | 1,12-dodecanediol | 9.57 | 49.0 | 1,10-decanedioic acid | 9.97 | 49.0 | 8.25 | n-triacontanoic acid | 30 | 2.0 |
| A22 | 12.28 | 1,4-butanediol | 11.87 | 42.0 | Fumaric acid | 12.83 | 49.0 | 8.25 | n-triacontanoic acid | 30 | 2.0 |
| | | 1,6-hexanediol | 10.83 | 7.0 | | | | | | | |
| A23 | 9.77 | 1,12-dodecanediol | 9.57 | 49.0 | 1,10-decanedioic acid | 9.97 | 49.0 | 8.40 | n-octadecanoic acid | 18 | 2.0 |
| A24 | 12.28 | 1,4-butanediol | 11.87 | 42.9 | Fumaric acid | 12.83 | 50.0 | — | — | — | — |
| | | 1,6-hexanediol | 10.83 | 7.1 | | | | | | | |

TABLE 2

| | | | Physical properties of crystalline polyester resin A | | | |
|---|---|---|---|---|---|---|
| | Sc $(cal/cm^3)^{1/2}$ | Sd $(cal/cm^3)^{1/2}$ | Fusion peak temperature ° C. | ΔH J/g | MwA — | Acid value mgKOH/g |
| A1 | 9.91 | 8.82 | 77 | 120 | 19000 | 2 |
| A2 | 9.91 | 8.40 | 76 | 120 | 17000 | 2 |
| A3 | 9.77 | 8.51 | 80 | 125 | 19000 | 2 |
| A4 | 9.62 | 8.92 | 82 | 122 | 17000 | 3 |
| A5 | 9.91 | 8.97 | 77 | 120 | 22000 | 2 |
| A6 | 10.34 | 8.97 | 74 | 117 | 13000 | 2 |
| A7 | 10.34 | 8.82 | 75 | 117 | 23000 | 4 |
| A8 | 10.96 | 8.25 | 72 | 106 | 24000 | 2 |
| A9 | 9.91 | 8.25 | 77 | 122 | 29000 | 4 |
| A10 | 9.36 | 8.97 | 88 | 138 | 15000 | 2 |
| A11 | 10.25 | 8.25 | 72 | 110 | 28000 | 2 |
| A12 | 10.40 | 8.25 | 67 | 105 | 23000 | 2 |
| A13 | 11.10 | 8.25 | 68 | 105 | 18000 | 2 |
| A14 | 11.34 | 8.25 | 105 | 95 | 18000 | 2 |
| A15 | 11.34 | 8.21 | 107 | 94 | 20000 | 2 |
| A16 | 11.34 | 8.83 | 105 | 96 | 19000 | 2 |
| A17 | 11.34 | 8.21 | 107 | 90 | 46000 | 2 |
| A18 | 11.34 | 8.83 | 105 | 88 | 10500 | 2 |
| A19 | 11.34 | 8.43 | 106 | 90 | 21000 | 2 |
| A20 | 11.10 | 9.69 | 66 | 75 | 21000 | 2 |
| A21 | 9.77 | 8.25 | 81 | 124 | 21000 | 2 |
| A22 | 12.28 | 8.25 | 125 | 77 | 15000 | 2 |
| A23 | 9.77 | 8.40 | 80 | 123 | 17000 | 2 |
| A24 | 12.28 | | 122 | 72 | 21000 | 2 |

Production Example of Crystalline Polyester Resins A2 to A24

Crystalline polyester resins A2 to A24 were obtained in the same manner as the production example of the crystalline polyester resin A1 with the exception of changing the type of monomer of the polyester molecular chain (C), the type of monomer of the crystal nucleating agent segment (D) and the blended amounts thereof in the production example of the crystalline polyester resin A1 to those described in Table 1. Various physical properties thereof are shown in Table 2.

In addition, a peak of a composition in which the crystal nucleating agent segment (D) was bonded to the end of the polyester molecular chain (C) was confirmed in MALDI-TOFMS mass spectrograms of the resulting crystalline polyester resins A2 to A23. Consequently, the crystalline polyester resins A2 to A23 were confirmed to be resins in which the crystal nucleating agent segment (D) is bonded to the end of the polyester molecular chain (C).

<Production Example of Amorphous Resin B1>

After placing a monomer of the polyester unit (E) in a reaction tank equipped with a nitrogen inlet tube, moisture removal tube, stirrer and thermocouple in the blended amount shown in Table 3, 1.5 parts by mass of a catalyst in the form of dibutyltin were added to 100 parts by mass as the total mass of the monomer of the polyester unit (E). The temperature was then raised to 160° C. while stirring in a nitrogen atmosphere.

Next, a mixture of a monomer of the vinyl polymer unit (F) (including bireactive compounds) in the blended amounts shown in Table 3 and 2.0 moles of a polymerization initiator in the form of benzoyl peroxide were prepared and dropped into the reaction tank from a dropping funnel over the course of 4 hours. At this time, the amount that was dropped in was adjusted to the mass ratio of the polyester unit (E) and the vinyl polymer unit (F) shown in Table 3. Following completion of dropping and reacting for 4 hours at 160° C., the pressure in the reaction system was reduced while raising the temperature to 230° C. to carry out a condensation polymerization reaction. At this time, the duration of condensation polymerization from the start of pressure reduction was set so that the softening point of amorphous resin B1 was the value shown in Table 3.

Following completion of the reaction of the amorphous resin B1, the resin was removed from the reaction tank followed by cooling and pulverizing to obtain the amorphous resin B1. Various physical properties of the amorphous resin B1 are as shown in Table 3.

Furthermore, in order to determine the duration of condensation polymerization to obtain a desired softening point, a preliminary study was conducted by changing the duration of the condensation polymerization reaction from the start of pressure reduction to a plurality of times, removing the amorphous resin from the reaction tank, cooling and pulverizing followed by measuring the softening point. The duration of condensation polymerization was determined so as to yield the softening point described in Table 3 based on the correlation between the duration of condensation polymerization and softening point for the formulation of the amorphous resin B1 obtained in the preliminary study.

<Production Example of Amorphous Resins B2 to B12>

Amorphous resins B2 to B12 were obtained in the same manner as the production example of the amorphous resin B1 with the exception of changing the type of monomer of the polyester unit (E), the type of monomer of the vinyl polymer unit (F), the blended amounts thereof and the duration of condensation polymerization in the production example of the amorphous resin B1 to those described in Table 3. Various physical properties thereof are shown in Table 3. A preliminary study of the duration of condensation polymerization was conducted in the same manner as the production example of the amorphous resin B1, and durations of condensation polymerization were determined so as to yield the softening points described in Table 3 based on the correlation between the duration of condensation polymerization and softening point for each of the resulting amorphous resin formulations.

<Production Example of Amorphous Resins B13 to B20 and B23>

Amorphous resins B13 to B20 and B23 were obtained in the same manner as the production example of the amorphous resin B1 with the exception of changing the type of monomer of the polyester unit (E), the type of monomer of the vinyl polymer unit (F), the blended amounts thereof and the duration of condensation polymerization in the production example of the amorphous resin B1 to those described in Table 4. Various physical properties thereof are shown in Table 4. A preliminary study of the duration of condensation polymerization was conducted in the same manner as the production example of the amorphous resin B1, and durations of condensation polymerization were determined so as to yield the softening points described in Table 4 based on the correlation between the duration of condensation polymerization and softening point for each of the resulting amorphous resin formulations.

<Production Example of Amorphous Resin 21>

After placing a monomer of the polyester unit (E) in a reaction tank equipped with a nitrogen inlet tube, moisture removal tube, stirrer and thermocouple in the blended amount shown in Table 3, 1.5 parts by mass of a catalyst in the form of dibutyltin were added to 100 parts by mass as the total mass of monomer of the polyester unit (E). The temperature was then rapidly raised to 180° C. while stirring in a nitrogen atmosphere.

Next, a condensation polymerization reaction was carried out by distilling off water while heating from 180° C. to 210° C. at ramp rate of 10° C./hour, pressure inside the reaction tank was reduced to 5 kPa or less after the temperature reached 210° C., and condensation polymerization was carried out until the softening point shown in Table 4 was reached to produce amorphous resin B21. Various properties of the amorphous resin B21 are shown in Table 4. A preliminary study of the duration of condensation polymerization was conducted in the same manner as the production example of the amorphous resin B1, and the duration of condensation polymerization was determined so as to yield the softening point described in Table 4 based on the correlation between the duration of condensation polymerization and softening point for each of the resulting amorphous resin formulations.

<Production Example of Amorphous Resin B22>

Amorphous resin B22 was obtained in the same manner as the production example of amorphous resin B21 with the exception of changing the type of monomer of the polyester unit (E) and the blended amount thereof in the production example of the amorphous resin B21 to those described in Table 4. Various properties of the amorphous resin B22 are shown in Table 4.

A preliminary study of the duration of condensation polymerization was conducted in the same manner as the production example of the amorphous resin B1, and the duration of condensation polymerization was determined so as to yield the softening point described in Table 4 based on the correlation between the duration of condensation polymerization and softening point for each of the resulting amorphous resin formulations.

TABLE 3

| | | | Amorphous resin B | | | | | | |
|---|---|---|---|---|---|---|---|---|---|
| | | SP value | B1 | B2 | B3 | B4 | B5 | B6 | B7 |
| | Vinyl copolymerized monomer | | | | | | | | |
| Vinyl copolymer unit (F) | Acrylic acid | 9.90 | 10 | 10 | 10 | 10 | 10 | 10 | 5 |
| | Fumaric acid | 12.83 | | | | | | | 2 |
| | Styrene | 8.93 | 53 | 10 | 20 | 61 | 15 | 30 | |
| | Behenyl methacrylate | 8.19 | | | | | | | 92 |
| | Stearyl methacrylate | 8.22 | | | | | 75 | | |
| | Lauryl methacrylate | 8.30 | | | | | | | |
| | 2-ethylhexyl methacrylate | 8.33 | | | | | | | |
| | Butyl acrylate | 8.69 | | | | | | | |
| | Behenyl acrylate | 8.23 | | 80 | 30 | | | | |
| | Stearyl acrylate | 8.27 | | | | 29 | | | |
| | Lauryl acrylate | 8.36 | | | | | | 60 | |
| | 2-ethylhexyl acrylate | 8.42 | 37 | | 40 | | | | |
| | Cyclohexyl methacrylate | 8.83 | | | | | | | |
| | Tertiary-butyl methacrylate | 6.89 | | | | | | | |
| | Sf | $(cal/cm^3)^{1/2}$ | 8.84 | 8.47 | 8.61 | 8.84 | 8.49 | 8.69 | 8.37 |
| | Alcohol monomer | | | | | | | | |
| Polyester unit (E) | BPA-PO | 9.51 | 60 | 37 | 45 | 32 | 32 | 28 | 37 |
| | BPA-EO | 9.74 | | 20 | 7 | | | 10 | 5 |

TABLE 3-continued

| | | | | | | | | | |
|---|---|---|---|---|---|---|---|---|---|
| | EG | 14.11 | | | | 3 | 3 | 16 | 12 |
| | PG | 12.7 | | | | | | | |
| | NPG | 8.37 | | | | 22 | 22 | | |
| | Acid monomer | | | | | | | | |
| | TPA | 10.28 | 37 | 39 | 25 | 28 | 28 | 39 | 39 |
| | IPA | 10.28 | 2 | | | | | | |
| | TMA | 11.37 | 1 | 4 | 5 | 3 | 3 | 7 | 7 |
| | FA | 12.83 | | | | | | | |
| | AA | 11.1 | | | 18 | | | | |
| | DSA | 9.33 | | | | 12 | 12 | | |
| | Se | $(cal/cm^3)^{1/2}$ | 9.83 | 9.93 | 10.10 | 9.65 | 9.65 | 10.70 | 10.50 |
| Mass ratio of polyester unit (E) and vinyl copolymer unit (F) (polyester unit:vinyl copolymer unit) | | | 80:20 | 60:40 | 90:10 | 80:20 | 80:20 | 80:20 | 80:20 |
| Physical properties of amorphous resin B | Tg | (° C.) | 67 | 63 | 62 | 62 | 61 | 65 | 68 |
| | Softening point | (° C.) | 117 | 123 | 127 | 125 | 125 | 125 | 119 |
| | Weight-average molecular weight MwB | (—) | 68,000 | 80,000 | 100,000 | 80,000 | 85,000 | 75,000 | 62,000 |
| | Acid value | (mgKOH/g) | 8 | 8 | 8 | 8 | 8 | 5 | 8 |

| | | | Amorphous resin B | | | | |
|---|---|---|---|---|---|---|---|
| | | SP value | B8 | B9 | B10 | B11 | B12 |
| | Vinyl copolymerized monomer | | | | | | |
| Vinyl copolymer unit (F) | Acrylic acid | 9.90 | 5 | 5 | 10 | 10 | 5 |
| | Fumaric acid | 12.83 | | 2 | | | 5 |
| | Styrene | 8.93 | 73 | | 61 | 70 | 65 |
| | Behenyl methacrylate | 8.19 | | | | | |
| | Stearyl methacrylate | 8.22 | | | | | |
| | Lauryl methacrylate | 8.30 | 22 | | | | |
| | 2-ethylhexyl methacrylate | 8.33 | | | | | |
| | Butyl acrylate | 8.69 | | | | | |
| | Behenyl acrylate | 8.23 | | 93 | | | |
| | Stearyl acrylate | 8.27 | | | | | |
| | Lauryl acrylate | 8.36 | | | | | |
| | 2-ethylhexyl acrylate | 8.42 | | | 29 | 20 | 25 |
| | Cyclohexyl methacrylate | 8.83 | | | | | |
| | Tertiary-butyl methacrylate | 6.89 | | | | | |
| | Sf | $(cal/cm^3)^{1/2}$ | 8.84 | 8.41 | 8.88 | 8.93 | 9.05 |
| | Alcohol monomer | | | | | | |
| Polyester unit (E) | BPA-PO | 9.51 | 37 | 60 | 20 | 20 | 20 |
| | BPA-EO | 9.74 | 20 | | 12 | 12 | 12 |
| | EG | 14.11 | | | 22 | 22 | 22 |
| | PG | 12.7 | | | | | |
| | NPG | 8.37 | | | | | |
| | Acid monomer | | | | | | |
| | TPA | 10.28 | 39 | 37 | 29 | 29 | 29 |
| | IPA | 10.28 | | 2 | 10 | 10 | 10 |
| | TMA | 11.37 | 4 | 1 | 7 | 7 | 7 |
| | FA | 12.83 | | | | | |
| | AA | 11.1 | | | | | |
| | DSA | 9.33 | | | | | |
| | Se | $(cal/cm^3)^{1/2}$ | 9.93 | 9.83 | 10.98 | 10.98 | 10.98 |
| Mass ratio of polyester unit (E) and vinyl copolymer unit (F) (polyester unit:vinyl copolymer unit) | | | 80:20 | 80:20 | 80:20 | 80:20 | 80:20 |
| Physical properties of amorphous resin B | Tg | (° C.) | 66 | 69 | 65 | 64 | 65 |
| | Softening point | (° C.) | 127 | 120 | 131 | 128 | 131 |
| | Weight-average molecular weight MwB | (—) | 80,000 | 85,000 | 115,000 | 110,000 | 105,000 |
| | Acid value | (mgKOH/g) | 11 | 8 | 8 | 9 | 8 |

BPA-PO: Bisphenol A 2 mol PO adduct
BPA-EO: Bisphenol A 2 mol EO adduct
EG: Ethylene glycol
PG: 1,2-propylene glycol
NPG: Neopentyl glycol
TPA: Terephthalic acid
IPA: Isophthalic acid
TMA: Trimellitic acid
FA: Fumaric acid
AA: Adipic acid
DSA: Dodecenyl succinic acid

TABLE 4

| | | SP value | Amorphous resin B | | | | | |
|---|---|---|---|---|---|---|---|---|
| | | | B13 | B14 | B15 | B16 | B17 | B18 |
| | Vinyl copolymerized monomer | | | | | | | |
| Vinyl copolymer unit (F) | Acrylic acid | 9.90 | 15 | 5 | 15 | 5 | 15 | 30 |
| | Fumaric acid | 12.83 | | 10 | | 10 | 5 | 5 |
| | Styrene | 8.93 | 75 | 85 | 75 | 85 | 80 | 65 |
| | Behenyl methacrylate | 8.19 | | | | | | |
| | Stearyl methacrylate | 8.22 | | | | | | |
| | Lauryl methacrylate | 8.30 | | | | | | |
| | 2-ethylhexyl methacrylate | 8.33 | | | | | | |
| | Butyl acrylate | 8.69 | 10 | | 10 | | | |
| | Behenyl acrylate | 8.23 | | | | | | |
| | Stearyl acrylate | 8.27 | | | | | | |
| | Lauryl acrylate | 8.36 | | | | | | |
| | 2-ethylhexyl acrylate | 8.42 | | | | | | |
| | Cyclohexyl methacrylate | 8.83 | | | | | | |
| | Tertiary-butyl methacrylate | 6.89 | | | | | | |
| | Sf | $(cal/cm^3)^{1/2}$ | 9.05 | 9.37 | 9.05 | 9.37 | 9.27 | 9.42 |
| | Alcohol monomer | | | | | | | |
| Polyester unit (E) | BPA-PO | 9.51 | 48 | 60 | 48 | 60 | 48 | 37 |
| | BPA-EO | 9.74 | | | | | | 20 |
| | EG | 14.11 | | | | | | |
| | PG | 12.7 | | | | | | |
| | NPG | 8.37 | 7 | | 7 | | 7 | |
| | Acid monomer | | | | | | | |
| | TPA | 10.28 | 21 | 37 | 21 | 37 | 21 | 39 |
| | IPA | 10.28 | | 2 | | 2 | | |
| | TMA | 11.37 | 4 | 1 | 4 | 1 | 4 | 4 |
| | FA | 12.83 | | | | | | |
| | AA | 11.1 | | | | | | |
| | DSA | 9.33 | 20 | | 20 | | 20 | |
| | Se | $(cal/cm^3)^{1/2}$ | 9.63 | 9.83 | 9.63 | 9.83 | 9.63 | 9.93 |
| Mass ratio of polyester unit (E) and vinyl copolymer unit (F) (polyester unit:vinyl copolymer unit) | | | 80:20 | 80:20 | 96:4 | 54:46 | 80:20 | 80:20 |
| Physical properties of amorphous resin B | Tg | (° C.) | 60 | 63 | 62 | 64 | 68 | 66 |
| | Softening point | (° C.) | 123 | 119 | 127 | 120 | 125 | 125 |
| | Weight-average molecular weight MwB | (—) | 105,000 | 72,000 | 98,000 | 78,000 | 108,000 | 109,000 |
| | Acid value | (mgKOH/g) | 9 | 8 | 8 | 8 | 8 | 12 |

| | | SP value | Amorphous resin B | | | | |
|---|---|---|---|---|---|---|---|
| | | | B19 | B20 | B21 | B22 | B23 |
| | Vinyl copolymerized monomer | | | | | | |
| Vinyl copolymer unit (F) | Acrylic acid | 9.90 | 5 | 5 | | | 15 |
| | Fumaric acid | 12.83 | | | | | |
| | Styrene | 8.93 | 85 | 85 | | | 75 |
| | Behenyl methacrylate | 8.19 | | | | | |
| | Stearyl methacrylate | 8.22 | | | | | |
| | Lauryl methacrylate | 8.30 | | | | | |
| | 2-ethylhexyl methacrylate | 8.33 | | | | | |
| | Butyl acrylate | 8.69 | | | | | 10 |
| | Behenyl acrylate | 8.23 | | | | | |
| | Stearyl acrylate | 8.27 | | | | | |
| | Lauryl acrylate | 8.36 | | | | | |
| | 2-ethylhexyl acrylate | 8.42 | 10 | 10 | | | |
| | Cyclohexyl methacrylate | 8.83 | | | | | |
| | Tertiary-butyl methacrylate | 6.89 | | | | | |
| | Sf | $(cal/cm^3)^{1/2}$ | 8.93 | 8.93 | | | 9.05 |
| | Alcohol monomer | | | | | | |
| Polyester unit (E) | BPA-PO | 9.51 | 37 | 24 | 37 | | 37 |
| | BPA-EO | 9.74 | 20 | 6 | 20 | | 5 |
| | EG | 14.11 | | 23 | | | 12 |
| | PG | 12.7 | | | | 55 | |
| | NPG | 8.37 | | | | | |
| | Acid monomer | | | | | | |
| | TPA | 10.28 | 39 | 20 | 39 | 35 | 39 |
| | IPA | 10.28 | | 10 | | | |
| | TMA | 11.37 | 4 | 7 | 4 | 5 | 7 |

TABLE 4-continued

| | | | | | | | |
|---|---|---|---|---|---|---|---|
| | FA | 12.83 | | | | | |
| | AA | 11.1 | | 10 | | | |
| | DSA | 9.33 | | | | 5 | |
| | Se | $(cal/cm^3)^{1/2}$ | 9.93 | 11.10 | 9.93 | 11.62 | 10.50 |
| Mass ratio of polyester unit (E) and vinyl copolymer unit (F) (polyester unit:vinyl copolymer unit) | | | 80:20 | 80:20 | | | 80:20 |
| Physical properties of amorphous resin B | Tg | (° C.) | 68 | 66 | 67 | 65 | 64 |
| | Softening point | (° C.) | 122 | 127 | 120 | 117 | 128 |
| | Weight-average molecular weight MwB | (—) | 100,000 | 115,000 | 91,000 | 107,000 | 112,000 |
| | Acid value | (mgKOH/g) | 14 | 11 | 13 | 13 | 12 |

BPA-PO Bisphenol A 2 mol PO adduct
BPA-EO: Bisphenol A 2 mol EO adduct
EG: Ethylene glycol
PG: 1,2-propylene glycol
NPG: Neopentyl glycol
TPA: Terephthalic acid
IPA: Isophthalic acid
TMA: Trimellitic acid
FA: Fumaric acid
AA: Adipic acid
DSA: Dodecenyl succinic acid <Production Example of Toner 1>

| | |
|---|---|
| Crystalline polyester resin A1 | 15.0 parts by mass |
| Amorphous resin B1 | 85.0 parts by mass |
| Carbon black | 5.0 parts by mass |
| Fischer-Tropsch wax (melting point: 105° C.) | 6.0 parts by mass |
| Aluminum 3,5-di-tert-butylsalicylate compound | 0.8 parts by mass |

The above-mentioned materials were mixed with a Henschel mixer (Model FM-75, Mitsui Miike Machinery Co., Ltd.) followed by kneading with a twin screw extruder (Model PCM-30, Ikegai Corp.) at a rotating speed of 3.3 $s^{-1}$ by adjusting the temperature of the extruder barrel so that the temperature of the kneaded resin was 10° C. higher than the softening point of the amorphous resin B1.

The resulting kneaded product was cooled and coarsely pulverized with a hammer mill to a size of 1 mm or less to obtain a coarsely pulverized product. The resulting coarsely pulverized product was finely pulverized with a mechanical pulverizer (T-250 manufactured by Turbo Kogyo Co., Ltd.). Moreover, the resulting finely pulverized powder was classified using a multi-grade classifier utilizing the Coanda effect to obtain negatively turboelectric charged particles having weight-average particle diameter (D4) of 7.1 μm.

1.0 part by mass of titanium oxide fine particles having a primary average particle diameter of 50 nm that had been surface-treated with 15% by mass of isobutyltrimethoxysilane and 0.8 parts by mass of hydrophobic silica fine particles having a primary average particle diameter of 16 nm that had been surface-treated with 15% by mass of hexamethyldisilazane were added to 100 parts by mass of the resulting toner particles followed by mixing with a Henschel mixer (Model FM-75, Mitsui Miike Machinery Co., Ltd.) to obtain a Toner 1.

Various physical properties and the values of Sc, Sd, Se and Sf of the Toner 1 are shown in Table 5. In addition, Relational Expressions 1 to 4 based on the values of Sc to Sf of the Toner 1 are shown in Table 6.

TABLE 5

| | | Crystalline polyester resin A | | | Amorphous resin B | | | | Toner physical properties | | |
|---|---|---|---|---|---|---|---|---|---|---|---|
| | Toner No. | No | Sc | Sd | No | Se | Sf | A:B | Tm (° C.) | Mw — | acid value |
| Example 1 | Toner 1 | A1 | 9.91 | 8.82 | B1 | 9.83 | 8.84 | 15:85 | 112 | 65000 | 8 |
| Example 2 | Toner 2 | A2 | 9.91 | 8.4 | B1 | 9.83 | 8.84 | 5:95 | 114 | 70000 | 9 |
| Example 3 | Toner 3 | A3 | 9.77 | 8.51 | B2 | 9.93 | 8.47 | 15:85 | 117 | 75000 | 7 |
| Example 4 | Toner 4 | A4 | 9.62 | 8.92 | B3 | 10.1 | 8.61 | 30:70 | 115 | 89500 | 8 |
| Example 5 | Toner 5 | A5 | 9.91 | 8.97 | B4 | 9.65 | 8.84 | 15:85 | 118 | 77000 | 8 |
| Example 6 | Toner 6 | A6 | 10.34 | 8.97 | B5 | 9.65 | 8.49 | 15:85 | 117 | 82000 | 8 |
| Example 7 | Toner 7 | A7 | 10.34 | 8.82 | B6 | 10.7 | 8.69 | 15:85 | 120 | 75000 | 6 |
| Example 8 | Toner 8 | A8 | 10.96 | 8.25 | B7 | 10.5 | 8.37 | 15:85 | 115 | 60000 | 9 |
| Example 9 | Toner 9 | A9 | 9.91 | 8.25 | B8 | 9.93 | 8.84 | 15:85 | 121 | 72000 | 10 |
| Example 10 | Toner 10 | A10 | 9.36 | 8.97 | B9 | 9.83 | 8.41 | 15:85 | 114 | 80000 | 8 |
| Example 11 | Toner 11 | A11 | 10.25 | 8.25 | B10 | 10.98 | 8.88 | 15:85 | 122 | 111000 | 8 |
| Example 12 | Toner 12 | A11 | 10.25 | 8.25 | B11 | 10.98 | 8.93 | 15:85 | 121 | 112000 | 8 |
| Example 13 | Toner 13 | A11 | 10.25 | 8.25 | B12 | 10.98 | 9.05 | 15:85 | 123 | 101000 | 7 |
| Example 14 | Toner 14 | A12 | 10.40 | 8.25 | B13 | 9.63 | 9.05 | 15:85 | 118 | 104000 | 8 |
| Example 15 | Toner 15 | A13 | 11.10 | 8.25 | B13 | 9.63 | 9.05 | 15:85 | 117 | 107000 | 7 |
| Example 16 | Toner 16 | A14 | 11.34 | 8.25 | B13 | 9.63 | 9.05 | 15:85 | 116 | 100500 | 7 |
| Example 17 | Toner 17 | A15 | 11.34 | 8.21 | B13 | 9.63 | 9.05 | 15:85 | 117 | 102500 | 8 |
| Example 18 | Toner 18 | A16 | 11.34 | 8.83 | B14 | 9.83 | 9.37 | 15:85 | 112 | 73000 | 9 |
| Example 19 | Toner 19 | A15 | 11.34 | 8.21 | B13 | 9.63 | 9.05 | 41:59 | 104 | 91000 | 8 |
| Example 20 | Toner 20 | A16 | 11.34 | 8.83 | B14 | 9.83 | 9.37 | 4:96 | 115 | 70000 | 9 |
| Example 21 | Toner 21 | A15 | 11.34 | 8.21 | B15 | 9.63 | 9.05 | 15:85 | 111 | 95000 | 8 |

TABLE 5-continued

| | | Crystalline polyester resin A | | | Amorphous resin B | | | | Toner physical properties | | |
|---|---|---|---|---|---|---|---|---|---|---|---|
| | Toner No. | No | Sc | Sd | No | Se | Sf | A:B | Tm (° C.) | Mw — | acid value |
| Example 22 | Toner 22 | A16 | 11.34 | 8.83 | B16 | 9.83 | 9.37 | 15:85 | 109 | 76000 | 7 |
| Example 23 | Toner 23 | A17 | 11.34 | 8.21 | B13 | 9.63 | 9.05 | 15:85 | 115 | 102000 | 9 |
| Example 24 | Toner 24 | A18 | 11.34 | 8.83 | B14 | 9.83 | 9.37 | 15:85 | 111 | 69000 | 8 |
| Example 25 | Toner 25 | A19 | 11.34 | 8.43 | B17 | 9.63 | 9.27 | 15:85 | 108 | 96000 | 8 |
| Comparative Example 1 | Toner 26 | A13 | 11.1 | 8.25 | B18 | 9.93 | 9.42 | 15:85 | 114 | 103000 | 13 |
| Comparative Example 2 | Toner 27 | A20 | 11.1 | 9.69 | B19 | 9.93 | 8.93 | 15:85 | 117 | 98000 | 15 |
| Comparative Example 3 | Toner 28 | A21 | 9.77 | 8.25 | B20 | 11.1 | 8.93 | 15:85 | 108 | 111000 | 11 |
| Comparative Example 4 | Toner 29 | A22 | 12.28 | 8.25 | B21 | 9.93 | — | 15:85 | 109 | 87000 | 13 |
| Comparative Example 5 | Toner 30 | A23 | 9.77 | 8.4 | B22 | 11.62 | — | 15:85 | 107 | 104000 | 11 |
| Comparative Example 6 | Toner 31 | A24 | 12.28 | — | B19 | 9.93 | 8.93 | 15:85 | 112 | 94000 | 12 |
| Comparative Example 7 | Toner 32 | A24 | 12.28 | — | B23 | 10.5 | 9.05 | 15:85 | 116 | 108000 | 12 |

TABLE 6

| | Toner No. | Judgment of Expression 1 | \|Sd − Se\| − \|Sd − Sf\| *1 | Judgment of Expression 2 | \|Sd − Sf\| | Judgment of Expression 3 | \|Sc − Sf\| − \|Sc − Se\| *2 | Expression 4 \|Sc − Se\| | \|Sc − Sf\| | \|Sd − Se\| | \|Se − Sf\| |
|---|---|---|---|---|---|---|---|---|---|---|---|
| Example 1 | Toner 1 | ○ | 0.99 | ○ | 0.02 | ○ | 0.99 | 0.08 | 1.07 | 1.01 | 0.99 |
| Example 2 | Toner 2 | ○ | 0.99 | ○ | 0.44 | ○ | 0.99 | 0.08 | 1.07 | 1.43 | 0.99 |
| Example 3 | Toner 3 | ○ | 1.38 | ○ | 0.04 | ○ | 1.14 | 0.16 | 1.30 | 1.42 | 1.46 |
| Example 4 | Toner 4 | ○ | 0.87 | ○ | 0.31 | ○ | 0.53 | 0.48 | 1.01 | 1.18 | 1.49 |
| Example 5 | Toner 5 | ○ | 0.55 | ○ | 0.13 | ○ | 0.81 | 0.26 | 1.07 | 0.68 | 0.81 |
| Example 6 | Toner 6 | ○ | 0.20 | ○ | 0.48 | ○ | 1.16 | 0.69 | 1.85 | 0.68 | 1.16 |
| Example 7 | Toner 7 | ○ | 1.75 | ○ | 0.13 | ○ | 1.29 | 0.36 | 1.65 | 1.88 | 2.01 |
| Example 8 | Toner 8 | ○ | 2.13 | ○ | 0.12 | ○ | 2.13 | 0.46 | 2.59 | 2.25 | 2.13 |
| Example 9 | Toner 9 | ○ | 1.09 | ○ | 0.59 | ○ | 1.05 | 0.02 | 1.07 | 1.68 | 1.09 |
| Example 10 | Toner 10 | ○ | 0.30 | ○ | 0.56 | ○ | 0.48 | 0.47 | 0.95 | 0.86 | 1.42 |
| Example 11 | Toner 11 | ○ | 2.10 | ○ | 0.63 | ○ | 0.64 | 0.73 | 1.37 | 2.73 | 2.10 |
| Example 12 | Toner 12 | ○ | 2.05 | ○ | 0.68 | ○ | 0.59 | 0.73 | 1.32 | 2.73 | 2.05 |
| Example 13 | Toner 13 | ○ | 1.93 | ○ | 0.80 | ○ | 0.47 | 0.73 | 1.20 | 2.73 | 1.93 |
| Example 14 | Toner 14 | ○ | 0.58 | ○ | 0.80 | ○ | 0.58 | 0.77 | 1.35 | 1.38 | 0.58 |
| Example 15 | Toner 15 | ○ | 0.58 | ○ | 0.80 | ○ | 0.58 | 1.47 | 2.05 | 1.38 | 0.58 |
| Example 16 | Toner 16 | ○ | 0.58 | ○ | 0.80 | ○ | 0.58 | 1.71 | 2.29 | 1.38 | 0.58 |
| Example 17 | Toner 17 | ○ | 0.58 | ○ | 0.84 | ○ | 0.58 | 1.71 | 2.29 | 1.42 | 0.58 |
| Example 18 | Toner 18 | ○ | 0.46 | ○ | 0.54 | ○ | 0.46 | 1.51 | 1.97 | 1.00 | 0.46 |
| Example 19 | Toner 19 | ○ | 0.58 | ○ | 0.84 | ○ | 0.58 | 1.71 | 2.29 | 1.42 | 0.58 |
| Example 20 | Toner 20 | ○ | 0.46 | ○ | 0.54 | ○ | 0.46 | 1.51 | 1.97 | 1.00 | 0.46 |
| Example 21 | Toner 21 | ○ | 0.58 | ○ | 0.84 | ○ | 0.58 | 1.71 | 2.29 | 1.42 | 0.58 |
| Example 22 | Toner 22 | ○ | 0.46 | ○ | 0.54 | ○ | 0.46 | 1.51 | 1.97 | 1.00 | 0.46 |
| Example 23 | Toner 23 | ○ | 0.58 | ○ | 0.84 | ○ | 0.58 | 1.71 | 2.29 | 1.42 | 0.58 |
| Example 24 | Toner 24 | ○ | 0.46 | ○ | 0.54 | ○ | 0.46 | 1.51 | 1.97 | 1.00 | 0.46 |
| Example 25 | Toner 25 | ○ | 0.36 | ○ | 0.84 | ○ | 0.36 | 1.71 | 2.07 | 1.20 | 0.36 |
| Comparative Example 1 | Toner 26 | ○ | 0.51 | X | 1.17 | ○ | 0.51 | 1.17 | 1.68 | 1.68 | 0.51 |
| Comparative Example 2 | Toner 27 | X | −0.52 | ○ | 0.76 | ○ | 1.00 | 1.17 | 2.17 | 0.24 | 1.00 |
| Comparative Example 3 | Toner 28 | ○ | 2.17 | ○ | 0.68 | X | −0.49 | 1.33 | 0.84 | 2.85 | 2.17 |
| Comparative Example 4 | Toner 29 | | — | | — | | — | 2.35 | — | 1.68 | — |
| Comparative Example 5 | Toner 30 | | — | | — | | — | 1.85 | — | 3.22 | — |
| Comparative Example 6 | Toner 31 | | — | | — | | — | 2.35 | 3.35 | — | 1.00 |
| Comparative Example 7 | Toner 32 | | — | | — | | — | 1.78 | 3.23 | — | 1.45 |

*1: Indicates difference between |Sd − Se| on right side of Expression 1 and |Sd − Sf| on left side. Expression 1 was judged to be satisfied if this is greater than 0.

*2: Indicates difference between |Sc − Sf| on right side of Expression 3 and |Sc − Se| on left side. Expression 3 was judged to be satisfied if this is greater than 0.

<Production Example of Toners 2 to 32>

Toners 2 to 32 were produced in the same manner as the production example of Toner 1 with the exception of changing the type of crystalline polyester resin A, the type of amorphous resin B and the mass ratio thereof in the production example of Toner 1 to those indicated in Table 5. Various physical properties of Toners 2 to 32 are shown in Table 5.

In addition, Relational Expressions 1 to 4 based on the values of Sc to Sf of Toners 2 to 32 are shown in Table 6.

Example 1

In the present example, a commercially available color laser printer in the form of the Color Laser Jet CP4525 (Hewlett Packard Co.) was used to evaluate the resulting Toner 1. Evaluations were carried out as described below after replacing the toner installed in the above-mentioned color laser printer with the Toner 1 produced in the present example.

(1) Low-Temperature Fixability when Using Heavy Paper (Upper Limit Fixation Speed)

The fixing unit of a commercially available color laser printer in the form of the Color Laser Jet CP4525 (Hewlett Packard Co.) was removed and an external fixing unit was fabricated so as to allow the fixation temperature, fixing nip back pressure and processing speed of the fixing apparatus to be set arbitrarily. Laser copier paper (GF-209, Canon Inc., A4 size, basis weight: 209 g/m$^2$) was used for the paper and a black cartridge was used for the evaluated cartridge evaluated in an environment at a temperature of 23° C. and relative humidity of 50%.

Namely, after removing commercially available toner from the commercially available black cartridge and cleaning the inside by blowing with air, the cartridge was filled with 200 g of Toner 1 of the present invention and evaluated.

Furthermore, evaluation was carried out by removing each of the commercially available toners at each of the magenta, yellow and cyan stations, and inserting empty magenta, yellow and cyan cartridges after disabling their residual toner level sensors. Subsequently, solid black, unfixed images were then output at a toner laid-on level of 0.80 mg/cm$^2$.

The above-mentioned solid black, unfixed images were fixed by setting the sleeve surface temperature of the fixing unit to 150° C., the fixing nipple back pressure to 0.13 MPa and increasing the processing speed over a range from 240 mm/sec to 400 mm/sec in 10 mm/sec intervals. The resulting solid black images were rubbed five times back and forth with lens-cleaning paper while applying a load of 100 g, and the condition under which the rate of decrease in image density before and after rubbing was 10% or less was taken to be the fixable processing speed. Furthermore, measurement of image density was carried out using X-Rite (500 Series, X-Rite, Inc., density measurement mode) and was determined by taking the average of five measurement points. The highest processing speed that satisfied the requirement of a rate of decrease in image density of 10% or less was taken to be the upper limit fixation speed, and the toner was judged to have superior low-temperature fixability when using heavy paper as the value of this upper limit fixation speed increased.

Results were evaluated according to the following criteria, and in the present invention, an evaluation of C or better was considered to be an acceptable level.

A: Upper limit fixation speed of 330 mm/sec or more

B: Upper limit fixation speed of from 290 mm/sec to less than 330 mm/sec

C: Upper limit fixation speed of from 240 mm/sec to less than 290 mm/sec

D: Upper limit fixation speed of less than 240 mm/sec (2) Toner Durability (Half-Tone Density Retention Rate)

Toner durability was evaluated using a commercially available color laser printer in the form of the Color Laser Jet CP4525 (Hewlett Packard Co.) in an environment a temperature of 32.5° C. and relative humidity of 80%. At this time, the printer was used after modifying the fixing unit so that the surface temperature of the sleeve was 150° C. Laser copier paper (GF-640, Canon Inc., A4 size, basis weight: 64 g/m$^2$) was used for the paper and a black cartridge was used for the cartridge used for evaluation.

Namely, after removing commercially available toner from the commercially available black cartridge and cleaning the inside by blowing with air, the cartridge was filled with 200 g of Toner 1 of the present invention and evaluated.

Furthermore, evaluation was carried out by removing each of the commercially available toners at each of the magenta, yellow and cyan stations, and inserting empty magenta, yellow and cyan cartridges after disabling their residual toner level sensors.

Subsequently, half-tone images were continuously output after adjusting to a dot ratio in the area of the half-tone image of 23% and a toner laid-on level of 0.10 mg/cm$^2$.

Image density was measured as the average of five locations for the first resulting half-tone image and the 20,000th half-tone image, respectively, and the image density of the 20,000th half-tone image was divided by the image density of the first half-tone image and multiplied by 100 to determine half-tone density retention rate.

A higher value for this half-tone density retention rate was judged to indicate superior toner durability. Results were evaluated according to the following criteria. In the present invention, an evaluation of C or better was considered to be an acceptable level.

A: Half-tone density retention rate of 90% or more

B: Half-tone density retention rate of from 80% to less than 90%

C: Half-tone density retention rate of from 60% to less than 80%

D: Half-tone density retention rate of less than 60%

(3) Toner Rate at which Charging Rises Up (Image Fogging After Continuous Solid Image Output)

The rate at which charging rises up of the toner was evaluated using a commercially available color laser printer in the form of the Color Laser Jet CP4525 (Hewlett Packard Co.) in an environment a temperature of 32.5° C. and relative humidity of 80%. At this time, the printer was used after modifying the fixing unit so that the surface temperature of the sleeve was 150° C.

Laser copier paper (GF-640, Canon Inc., A4 size, basis weight: 64 g/m$^2$) was used for the paper and a black cartridge was used for the cartridge used for evaluation.

Namely, after removing commercially available toner from the commercially available black cartridge and cleaning the inside by blowing with air, the cartridge was filled with 200 g of Toner 1 of the present invention and evaluated.

Furthermore, evaluation was carried out by removing each of the commercially available toners at each of the magenta, yellow and cyan stations, and inserting empty magenta, yellow and cyan cartridges after disabling their residual toner level sensors.

After continuously outputting 50 solid images having a coverage rate of 50%, a single sheet of white paper was output as the 51st sheet without interrupting operation of the printer. Reflectance (%) was measured at five locations each on the 51st sheet of white paper and a sheet of white paper that had not been passed through the printer using a digital white light spectrophotometer (Model TC-6D, Tokyo Denshoku Co., Ltd., using a green filter) followed by determination of the average value thereof. The difference between the average values of the reflectance (%) of both sheets of paper was determined and used as the value of image fogging (%) following continuous solid image output.

A lower value for image fogging following continuous solid image output was judged to indicate a superior rate at which charging rises up of the toner. Results were evaluated according to the following criteria. In the present invention, an evaluation of C or better was considered to be an acceptable level.

A: Image fogging after continuous solid image output of less than 0.5%

B: Image fogging after continuous solid image output of from 0.5% to less than 1.0%

C: Image fogging after continuous solid image output of from 1.0% to less than 1.5%

D: Image fogging after continuous solid image output of 1.5% or more (4) Image Gloss Uniformity (Rate of Change in Image Gloss)

The image gloss uniformity of the toner was evaluated by removing the fixing unit of a color laser printer in the form of the Color Laser Jet CP4525 (Hewlett Packard Co.) and using an external fixing unit so as to allow the fixation temperature, fixing nip back pressure and processing speed of the fixing apparatus to be set arbitrarily.

Laser copier paper (GF-0081, Canon Inc., A4 size, basis weight: 81.4 g/m$^2$) was used for the paper and a cyan cartridge and magenta cartridge were used for evaluation in an environment at a temperature of 23° C. and relative humidity of 50%.

Namely, after removing commercially available toner from the commercially available cyan cartridge and magenta cartridge and cleaning the inside by blowing with air, each cartridge was filled with 200 g of Toner 1 of the present invention and inserted at its respective station.

Furthermore, evaluation was carried out by removing each of the commercially available toners at each of the black and yellow stations, and inserting empty black and yellow cartridges after disabling their residual toner level sensors. Subsequently, unfixed images were output having a secondary color solid image at a toner laid-on level of 0.80 mg/cm$^2$ and primary color solid image at a toner laid-on level of 0.40 mg/cm$^2$ on the same paper at the cyan station and magenta station based on the assumption of their use as primary and secondary colors.

The unfixed images were fixed by setting the sleeve surface temperature of the fixing unit to 150° C., the fixing nipple back pressure to 0.13 MPa and the processing speed to 300 mm/sec.

The 60° gloss values were respectively measured for the secondary color solid image area having a toner laid-on level of 0.80 mg/cm$^2$ and the primary color solid image area having a toner laid-on level of 0.40 mg/cm$^2$ of the resulting fixed images using a Handy Gloss Meter (Model PG-1M, Tokyo Denshoku Co., Ltd.). The difference between the 60° gloss value of the secondary color solid image area and the 60° gloss value of the primary color solid image area was determined, divided by the 60° gloss value of the secondary solid image area and multiplied by 100 to determine the rate of change (%) of image gloss.

A lower value for this rate of change (%) of image gloss was judged to indicate superior image gloss uniformity of the toner. Results were evaluated according to the following criteria. In the present invention, an evaluation of C or better was considered to be an acceptable level.

A: Rate of change of image gloss (%) of less than 10%

B: Rate of change of image gloss (%) of from 10% to less than 15%

C: Rate of change of image gloss (%) of from 15% to less than 25%

D: Rate of change of image gloss (%) of 25% or more (5) Toner Charge Stability (Difference in Image Fogging Before and After Standing)

Toner charge stability was evaluated using a commercially available color laser printer in the form of the Color Laser Jet CP4525 (Hewlett Packard Co.) in an environment at a temperature of 32.5° C. and relative humidity of 80%. At this time, the printer was used after modifying the fixing unit so that the surface temperature of the sleeve was 150° C.

Laser copier paper (GF-640, Canon Inc., A4 size, basis weight: 64 g/m$^2$) was used for the paper and a black cartridge was used for the cartridge used for evaluation.

Namely, after removing commercially available toner from the commercially available black cartridge and cleaning the inside by blowing with air, the cartridge was filled with 200 g of Toner 1 of the present invention and evaluated.

Furthermore, evaluation was carried out by removing each of the commercially available toners at each of the magenta, yellow and cyan stations, and inserting empty magenta, yellow and cyan cartridges after disabling their residual toner level sensors.

Subsequently, after continuously outputting 10 half-tone images after adjusting to a dot ratio in the area of the half-tone image of 23% and a toner laid-on level of 0.10 mg/cm$^2$, white paper was output for the 11th image and the 11th sheet of white paper was sampled (White Paper A). After subsequently allowing to stand for 3 days, a single sheet of white paper was output and sampled (White Paper B).

Reflectance (%) was measured at five locations each on the White Paper A and the White Paper B using a digital white light spectrophotometer (Model TC-6D, Tokyo Denshoku Co., Ltd., using a green filter) followed by determination of the average value thereof. The difference between the average values of the reflectance (%) of both paper samples was determined and used as the difference in image fogging (%) before and after standing.

A lower value for the difference in image fogging (%) before and after standing was judged to indicate superior charge stability of the toner. Results were evaluated according to the following criteria. In the present invention, an evaluation of C or better was considered to be an acceptable level.

A: Difference in image fogging (%) before and after standing of less than 0.5%

B: Difference in image fogging (%) before and after standing of from 0.5% to less than 1.0%

C: Difference in image fogging (%) before and after standing of from 1.0% to less than 1.5%

D: Difference in image fogging (%) before and after standing of 1.5% or more

Favorable results were obtained in all of the above evaluations relating to Example 1. The evaluation results of Example 1 are shown in Table 7.

TABLE 7

| | Toner No. | Low-temperature fixability when using heavy paper Upper limit fixation speed (mm/sec) | Toner durability Half-tone density retention rate (%) | Rate at which charging rises up Image fogging after continuous solid image output (%) | Image gloss uniformity Rate of change in image gloss (%) | Charge stability Difference in image fogging before and after standing (%) |
|---|---|---|---|---|---|---|
| Example 1 | Toner 1 | A (380) | A (95) | A (0.1) | A (3) | A (0.1) |
| Example 2 | Toner 2 | A (380) | A (94) | A (0.1) | A (3) | A (0.1) |
| Example 3 | Toner 3 | A (360) | A (94) | A (0.2) | A (3) | A (0.2) |
| Example 4 | Toner 4 | A (340) | A (93) | A (0.2) | A (4) | A (0.2) |
| Example 5 | Toner 5 | A (330) | B (87) | A (0.3) | A (5) | A (0.2) |
| Example 6 | Toner 6 | A (330) | B (84) | A (0.3) | A (5) | A (0.2) |
| Example 7 | Toner 7 | B (320) | A (92) | A (0.3) | A (8) | A (0.2) |
| Example 8 | Toner 8 | B (320) | A (92) | A (0.3) | A (8) | A (0.2) |
| Example 9 | Toner 9 | B (310) | A (91) | B (0.5) | A (8) | A (0.2) |
| Example 10 | Toner 10 | B (310) | B (83) | B (0.6) | A (8) | A (0.2) |
| Example 11 | Toner 11 | C (290) | A (91) | B (0.6) | A (9) | A (0.4) |
| Example 12 | Toner 12 | C (290) | A (90) | B (0.7) | A (9) | B (0.7) |
| Example 13 | Toner 13 | C (290) | A (90) | B (0.8) | A (9) | C (1.1) |
| Example 14 | Toner 14 | B (310) | B (83) | B (0.8) | A (8) | C (1.1) |
| Example 15 | Toner 15 | B (310) | B (82) | B (0.8) | B (13) | C (1.1) |
| Example 16 | Toner 16 | B (290) | B (83) | B (0.8) | C (18) | C (1.1) |
| Example 17 | Toner 17 | C (260) | B (81) | B (0.8) | C (19) | C (1.1) |
| Example 18 | Toner 18 | B (290) | C (75) | B (0.8) | C (17) | C (1.2) |
| Example 19 | Toner 19 | C (270) | C (74) | B (0.9) | C (19) | C (1.1) |
| Example 20 | Toner 20 | C (250) | C (75) | B (0.9) | C (18) | C (1.2) |
| Example 21 | Toner 21 | C (260) | B (80) | C (1.2) | C (17) | C (1.1) |
| Example 22 | Toner 22 | C (260) | C (72) | B (0.9) | C (20) | C (1.3) |
| Example 23 | Toner 23 | C (260) | C (72) | B (0.9) | C (19) | C (1.1) |
| Example 24 | Toner 24 | B (290) | C (71) | C (1.2) | C (17) | C (1.3) |
| Example 25 | Toner 25 | C (250) | C (69) | C (1.3) | C (20) | C (1.3) |
| Comparative Example 1 | Toner 26 | D (180) | C (61) | D (2.2) | C (23) | D (1.8) |
| Comparative Example 2 | Toner 27 | D (180) | D (49) | D (1.9) | C (23) | D (1.8) |
| Comparative Example 3 | Toner 28 | D (170) | C (62) | D (1.9) | C (24) | D (1.9) |
| Comparative Example 4 | Toner 29 | C (240) | D (47) | D (2.3) | D (37) | D (2.0) |
| Comparative Example 5 | Toner 30 | C (240) | D (49) | D (2.1) | D (33) | D (1.5) |
| Comparative Example 6 | Toner 31 | D (160) | D (37) | D (2.5) | D (37) | D (2.1) |
| Comparative Example 7 | Toner 32 | D (150) | D (39) | D (2.4) | D (33) | D (2.3) |

<Examples 2 to 25 and Comparative Examples 1 to 7>

Evaluation results were obtained for Examples 2 to 25 and Comparative Examples 1 to 7 in the same manner as Example 1 with the exception of changing the toner used for evaluation in Example 1 to those shown in Table 7. The evaluation results for Examples 2 to 25 and Comparative Examples 1 to 7 are shown in Table 7.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-160759, filed Aug. 1, 2013, which is hereby incorporated by reference herein in its entirety.

What is claimed is:

1. A toner having toner particle containing a crystalline polyester resin A, an amorphous resin B and a colorant, wherein (1) the crystalline polyester resin A is a resin that has a crystal nucleating agent segment (D) on the end of a polyester molecular chain (C), (2) the amorphous resin (B) is a hybrid resin in which a polyester unit (E) and a vinyl polymer unit (F) are chemically bonded, and (3) when the SP value of the polyester molecular chain (C) is defined as Sc $((cal/cm^3)^{1/2})$, the SP value of the crystal nucleating agent segment (D) is defined as Sd $((cal/cm^3)^{1/2})$, the SP value of the polyester unit (E) is defined as Se $((cal/cm^3)^{1/2})$, and the SP value of the vinyl polymer unit (F) is defined as Sf $((cal/cm^3)^{1/2})$, then the Sc, the Sd, the Se and the Sf satisfy the following expressions 1 to 3.

$$|Sd-Sf|<|Sd-Se| \quad \text{(Expression 1)}$$

$$|Sd-Sf|\leq 1.00 \quad \text{(Expression 2)}$$

$$|Sc-Se|<|Sc-Sf| \quad \text{(Expression 3).}$$

2. The toner according to claim 1, wherein the crystal nucleating agent segment (D) is a segment derived from one of an aliphatic monoalcohol having 10 to 30 carbon atoms and an aliphatic monocarboxylic acid having 11 to 31 carbon atoms.

3. The toner according to claim 1, wherein the Sc and the Se satisfy the following Expression 4

$$|Sc-Se| \leq 1.50 \quad \text{(Expression 4).}$$

4. The toner according to claim 1, wherein the Sf satisfies the following Expression 5

$$Sf \leq 9.00 \quad \text{(Expression 5).}$$

5. The toner according to claim 1, wherein the mass ratio of the crystalline polyester resin A and the amorphous resin B in the toner particle is such that the ratio of crystalline polyester resin A: amorphous resin B is 5:95 to 40:60.

6. The toner according to claim 1, wherein the mass ratio of the polyester unit (E) and the vinyl polymer unit (F) in the amorphous resin B is such that the ratio of polyester unit (E): vinyl polymer unit (F) is 55:45 to 95:5.

7. The toner according to claim 1, wherein the content of the crystal nucleating agent segment (D) with respect to all monomer-derived units composing the crystalline polyester resin A is from 0.10 mol % to 7.00 mol %.

8. The toner according to claim 1, wherein |Se−Sf| is 0.40 or more.

* * * * *